US006659691B1

(12) United States Patent
Berry

(10) Patent No.: US 6,659,691 B1
(45) Date of Patent: Dec. 9, 2003

(54) PILE ARRAY ASSEMBLY SYSTEM FOR REDUCED SOIL LIQUEFACTION

(76) Inventor: Richard M. Berry, P.O. Box 23009, Knoxville, TN (US) 37933

( * ) Notice: Subject to any disclaimer, the term of this patent is extended or adjusted under 35 U.S.C. 154(b) by 0 days.

(21) Appl. No.: 10/191,102

(22) Filed: Jul. 8, 2002

(51) Int. Cl.[7] ..... E02D 27/16; E02D 5/22

(52) U.S. Cl. ..... 405/231; 52/169.9

(58) Field of Search ..... 405/195.1, 229–231, 405/258.1, 259.1, 259.5; 52/169.9

(56) References Cited

U.S. PATENT DOCUMENTS

| | | | | | |
|---|---|---|---|---|---|
| 3,464,215 | A | * | 9/1969 | Spanovich | 405/233 |
| 3,886,754 | A | * | 6/1975 | Turzillo | 405/239 |
| 3,975,917 | A | * | 8/1976 | Asayama | 405/232 |
| 4,540,316 | A | | 9/1985 | Takahashi | |
| 4,707,956 | A | * | 11/1987 | Sato | 52/167.4 |
| 4,832,533 | A | * | 5/1989 | Ringesten | 405/233 |
| 5,118,223 | A | * | 6/1992 | Taki | 405/267 |
| 5,669,736 | A | | 9/1997 | Lin | |

OTHER PUBLICATIONS

Finn Ledbetter and Guoxi, Liquefaction In Silty Soils: Design and Analysis ASCE, Geotechnical Special Publication (GSP) No. 44, Oct., 1994–pp. 51–76; Special Note FIG. 13, page 68.

Yourman, Rashidi, Diaz and Owaidht, "Quality Control of Strong Columns In Variable Soils", ASCE, GSP No. 49, Oct., 1995; pp. 96–110, Special Note p. 101.

Liu and Dobry; "Seismic Response of Shallow Foundation On Liquefiable Sand"; Journal of Geotechnical and Geoenvironmental Engineering (Journal G&GE), vol. 123, No. 6, Jun. 1997; pp. 557–567, special note p. 559, FIG. 4(b).

Galsworthy and Elnaggar; "Analysis of R/C Chimneys with Soil–Structure Interaction"; ASCE, GSP No. 70, Oct., 1997; pp. 23–35, special note p. 25 Fig. 1a.

Han and Cathro; "Seismic Behavior of Tall Buildings Supported on pile Foundations"; ASCE, GSP No. 70; Oct., 1997; pp. 36–51, special note p. 44.

Kagawa, Sajo and Minowa–"Soil–Pile–Structure Interaction in Liquefying Sand from Large–Scale Shaking–Table and Cetrifuge Tests"; ASCE, GSP No. 70, pp. 69–84, Special Note p. 71.

Kaynia–"Earthquake Induced Forces in piles in layered Soil Media"; ASCE, GSP No. 70; Oct., 1997, pp. 85–95, Special Note p. 87.

Ivanetich, Gularte and Dees;"Compaction Grout: A Case History of Seismic Retrotit"; ASCE, Proceedings of the Gro–DenverConf.; Aug., 2000, pp. 83–93, special note p. 87.

(List continued on next page.)

*Primary Examiner*—Robert E. Pezzuto
*Assistant Examiner*—Tara L. Mayo

(57) ABSTRACT

A pile array assembly system for use in interaction with a ground site having adjacent building or structure footing or equivalent foundational support for reduced soil liquefaction in the event of seismic disturbance. The system is provided with a number of pile array subassemblies which relate to each other positionally and structurally to cooperate in deflecting seismic shock waves and also densifying the ground site to provide reduced soil liquefaction. Various arcuate or arc-linked pile units are placed as pile array subassemblies, in preferred embodiments, to utilize multiple configurational peripheries or perimeters of pile units. Additionally, in preferred embodiments, individual pile units within a subassembly are slanted or slanted and rotationally advanced or spun to achieve positioning for improved and advanced subground seismic wave deflection and dissipation.

31 Claims, 13 Drawing Sheets

OTHER PUBLICATIONS

Davis and Berrill; "Pore Pressure and Dissipated Energy in Earthquakes–Field Verification"; Journal G & GE, vol. 127, No. 3, Mar. 2001; pp. 269–274.

Bonita, Mitchell and Brandon;"In–Situ Liquefaction Evaluation Using a Vibrating Penetrometer"; ASCE, GSP No. 107, Proceeding of Conference –Denver, 2000; pp. 191–205.

Tabesh and Poulos; "Pseudostatic Approach For Seisimic Analysis of Single piles"; Journal G & GE, vol. 127, No. 9; Sep. 2001; pp. 757–765, special note p. 763.

Ashford, Rollins and Baez; "Comparison of Deep Foundation Performance in Improved and Non–improved Ground Using Blast–Induced Liquefaction"; ASCE, GSP No. 107, Proceedings of Conference–Denver, 2000; pp. 20–34, Special Note p. 30.

* cited by examiner (COMPACTION PILE–REINFORCED)

BY LIFTING DEEP UNDERGROUND, FORCES AT SURFACE ARE DISSIPATED AND KEPT LOW.

PILE ARRAY ASSEMBLY SYSTEM FOR REDUCED SOIL LIQUEFACTION

BACKGROUND OF THE INVENTION

1. Field of The Invention

The present invention relates to apparatus, methods and assembly systems for utilizing various types of pile and grouting members to provide a special patterning and array of such members for reduced soil liquefaction in the event of earthquake or other seismic disturbance.

2. Background Information

Although no references were found specifically relating to the vast improvements that the present invention discloses and teaches in this technology; some of the references which disclose aspects of the general technology in an experimental or theoretic sense, include United States Patents to Ringsten, U.S. Pat. No. 4,832,533; Taki, U.S. Pat. No. 5,118,223; Asayama, U.S. Pat. No. 3,975,917; Sato, U.S. Pat. No. 4,707,956; Spanovich, U.S. Pat. No. 3,464,215; and Turzillo, U.S. Pat. No. 3,886,754, and published references including Finn et al., "Liquefaction in Silty Soils: Design and Analysis," ASCE, GSP 44, October, 1994, pp. 51–78; Yourman et al., "Quality Control of Stone Columns in Variable Soils," ASCE Geotechnical Special Publication n. 90, pp.96–110; Liu and Dobry, "Seismic Response of Shallow Foundation on Liquefiable Sand," ASCE, Journal G&GE, June, 1997, pp. 557–567; Galsworthy and El Naggar, "Analysis of R/C Chimneys with Soil-Structure Interaction," ASCE, GSP 70, October, 1997, pp 23–35; Han and Cathro, "Seismic Behavior of Tall Buildings Supported On pile Foundations," ASCE, GSP 70, October, 1997, pp. 36–51; Kagawa et al., "Soil-Structure-Pile Interaction in Liquefying Sand From Large-Scale Shaking-Table Tests and Centrifuge Tenst," ASCE, GSP 70, October, 1997, pp. 69–84; Kaynia, "Earthquake Induced Forces in Piles in Layered Soil Media," ASCE, GSP 70, October, 1997, pp. 85–95; Ivanetich et al., "Compaction Grout: A Case History of Seismic Retrofit," ASCE, Proceedings of the Geo Denver Conference, August, 2000, pp. 83–93; Desai, "DCS Constitutive and Computer Models for Soil-Structure and Liquefaction Analysis," ASCE Geotechnical Special Publication no. 110, pp. 99–116; Davis and Berrill, "Pore Pressure and Dissipated Energy in Earthquakes Field Verification," ASCE Journal G&GE, March, 2001, pp. 269–274; Ashford et al., "Comparison of Deep Foundation Performance in Improved and Non-Improved Ground Using Blast-Induced Liquefaction," ASCE Geotechnical Special Publication no. 107, pp. 20–34; Bonita et al., "In Situ Liquefaction Evaluation Using a Vibrating Penetrometer," ASCE Geotechnical Special Publication no. 107, pp. 191–206; Helwany et al., "Seismic Analysis of Segmental Retaining Walls, I: Model Verification," ASCE JG&G, September, 2001, pp. 741–749; and Tebesh and Paulos, "Pseudostatic Approach for Seismic Analysis of Single Piles," ASCE JG&G, September, 2001, pp. 757–765. Perhaps the most important place for publication of earthquake and related technology articles and other information has been considered to be the Journal of Geotechnical and Environmental Engineering, a publication of the ASCE.

The Ringesten '533 patent reference discloses a process having as it principal teaching the removal of some of the soil below the foundation of a structure and replacing the soil with a 'lighter material' such as a foamed plastic or such matter as hollow plastic balls; to theoretically provide a soil layer which will distribute the loads from the structure foundations over a broader and deeper soil layer where support will be adequate while at the same time providing some buoyancy to the structure. Although drawings are disclosed in Ringesten which appear to result in an array having some similarity in relation to the present invention; the drawings, in fact, illustrate 'drill casings' which, in accordance with Ringesten, are subsequently removed when the 'light material' is being placed.

The Taki '223 reference discloses an insitu process to form columns by a 'soil mixing' process. It is disclosed in this regard that when the soil is not amenable to jet grouting, that the Taki process may be utilized. Large auger shaped drills are bored into the soil. What appears to look like 'augers' are, in fact, 'half auger' sections which act as mixers by alternately lifting and dropping the soil around the blades. While this is going on, cement grout is injected to mix with the soil, as is also the case in 'jet grouting.' The Taki process is, however, useable with a great many more types of soil than is jet grouting. In the technology, however, it is important to note that neither jet grouting nor soil mixing is really grouting, as applied in the present invention, at all.

Asayama '917 describes a process which involves placement of piles which have a horizontally fluted exterior profile. It has little connection to the present invention.

The Sato '956 reference relates to the installation of pile elements connected to a foundation in which movement of the top part of the pile is insulated from the soil directly under the foundation, with the deeper section of the pile carrying support down to deep soil strata. This invention appears to embrace the theory about decreasing the damage from earthquake shock, which says that the soil close under the foundation of a structure should not be compacted. However, this theory is debated and now discounted by most earthquake design engineers. Whether such support, disclosed in Sato, should be utilized, or designed in, is probably a site specific decision involving the types of soil encountered, their density, and the layering present in the formation. The Sato invention has little comparison to the broadly applicable array, and support superiority, of the present invention.

The Spanovich '215 Patent concerns a method of filling voids while preventing cement grout from escaping endlessly into such voids. Spanovich applies almost exclusively to voids in rock although it could possible apply to very stiff soils which act, or have similar properties, much like rock. This invention has almost no connection with settlement or damage due to liquefaction of soil; and, therefore, does not reasonably relate to the structural or functional purposes of the present invention.

Lin '736 discloses the construction of pile which has larger diameter areas where the soil of a site is soft and smaller diameter areas where the soil is dense. As disclosed, the horizontally fluted exterior profile, structurally, can assist in support of foundation loads in some soils. Lin teaches that additional support can be created by making the bottom section a 'belled' section.

The Takahashi '316 patent reference describes what is known in the geotechnical field as 'lense grouting.' As disclosed and illustrated, a cement slurry grout is pumped into loose soil for the purpose of 'fracturing' such soil. Because soil is usually laid down in horizontal layers, the 'fractures' are usually horizontal along the weak zones. This process leaves a web of cement grout channels, or 'lenses'; hence the derivation of its name. The soil on site, exposed to such a process, is not materially changed. Lense grouting is the opposite, conceptually, from compaction grouting, utilized in the present invention, where the bulk of the soil on site is densified. The creation of the lenses can be made somewhat more uniform by starting the grout flow into a hole at a high rate to create a lense; and, then, slowing the rate to expand the lense in thickness. It is possible that the stronger soil mass with its irregular web of lenses could deflect earthquake shock waves in some random fashion, but it would not lend itself to predictability. The Takahashi process appears unrelated to the compaction pile concepts, utilization and configurational positioning and arrays of the present invention.

The Turzillo '754 patent reference discloses a process used to hold a drilled hole open while cement grout is pumped in, for the purpose of creating an insitu pile. The process is widely utilized today, conventionally, to install mini-piles. The resulting pile, however, in and of itself, has no specific characteristics and the surrounding soil on site is not compacted or densified, as is the case of employing the teaching of the present invention.

In the Finn publication, the analysis disclosed predicates itself on the fact that piles situated in a sandy soil dramatically reduce the liquefaction potential. A model set forth regarding dam failure showed that the most stressed zone was upstream of the spillway and below the bottom of the dam fill. Piles were driven into that weak zone in a test case at the Sardis Dam in British Columbia. Post treatment soil tests indicated that this pile reinforcing in the express critical, weak zone prevented liquefaction and increased the apparent factor of safety of the dam some threefold. However, in this study, soils were not compacted, as utilized in the present invention.

The Yourman publication discloses a study where the density of the soil was used to attempt to measure the consistency with which stone column data would replicate. The correlation was not found to be good. There was no discussion relating to the present invention, though stone columns are illustrated as laid out in some spaced pattern, in a design test section.

The Liu and Dobry publication discloses experiments conducted utilizing a viscous fluid (ethylene glycol) to simulate increased gravity (as with a centrifuge). The experimental results were correlated with actual results from several earthquakes and with centrifuge data. The intention of the publication appears to be based on providing another possible method of detecting before and after differences utilizing support methods. One of the publication's diagrams (FIGS. 4(*a*) and 4(*b*)) discloses an area where pore pressure transducers and accelerometers are installed at desired locations in the 'model' used, at appropriate times during deposition. It is intended to illustrate, after the whole thickness of the sand has been placed, that a vibrating tube, 6.4 mm. in diameter (0.5 m. prototype), is inserted into the sand at 19 locations over a circular area having a diameter about 60% larger than the footing diameter (identified as "B" in the diagram) so as to compact the sand under and around the assumed footing location. This is very different in structure, patterning and functional scope and purpose than that of the present Pile Array Assembly System of the present invention.

The Galsworthy and El Naggar publication analyzes the effects of foundation types on the resistence of tall chimneys to earthquake damage. The types of foundations examined included those on piles extending to rock, those on friction piles and those on floating mats. The finding was that the more flexible the foundation, the lower the magnitude of damage to the chimney. In this publication one of the diagrams presented (FIG. 1*a*) illustrates a conventional end-Bearing Pile Foundation, having no similarity to the structural novelties of the present invention.

The Han and Cathro publication addresses seismic behavior of tall buildings supported on conventional pile foundations; and specifically concerns the analysis of a 20 story building on a square foundation. Two options of pile arrangements are disclosed and assumed to be friction piles as is customary in the technology, placed using 4×4 and 5×5 spacing options. The piles used are disclosed as being pre-cast concrete with a diameter of 0.4 m., installed by driving each a depth of 24 m. The soil interaction is said to sizably reduce the cycle of vibration and to transfer smaller strains into the structure. This is said to result in less movement at higher frequency.

The Kagawa publication addresses soil-structure-pile interaction in liquefying sand from large-scale shaking-table and centrifuge tests; and suggests that the main damage of a pile-supported tall structure occurs where the piles are attached at the top portion thereof in the foundation, and at the bottom portion thereof where founded on rock or on stiff soils. The publication indicates that there is little stress or damage to the middle section of respective piles.

The Kaynia work addresses earthquake induced forces in piles in layered soil media, and sets forth an analysis of pile interactive forces inlayers of different soil, indicating that major damage occurs where the soil is weak. No differentiation is made. This appears to be confirmed in many studies made regarding the Loma Prieta damage. A conventional pile-soil-structure system is illustrated (FIG. 1) in this publication.

The Ivanetich publication of August, 2000 is entitled: "Compaction Grout: A Case History of Seismic Retrofit." The publication describes an extensive program of soil grouting beneath the foundations of a bridge in California, where the intention or functional purpose of the approach was soil stability and support with respect to improvement of soil of the type which tends to liquefy under the shock forces of an earthquake. The type of improvement disclosed in this publication appears to exploit the well known features of soil compaction in the technology by compaction grouting; i.e., the soil being densified insitu to resist liquefaction simply by creating a more dense soil. The results reported were verified by before-and-after soil density readings. The measurement methods employed involved obtaining standard penetration test (SPT) and cone penetration (CPT) readings in the area where the grouting was carried out and baseline data being obtained on the soil density in the zone where settlement was considered to be most likely to occur. Compaction grout columns of injections were then placed utilizing a prescribed pattern and depth of injection. Examples of this compaction grouting layout, regarding two (2) Pier structure sites, are set forth at FIG. 2 of the Ivanetich publication, at page 87. The layout appears to utilize grouting locations for parallel and square-rectangular-grid arrangement of Primary Grout Locations, Secondary Grout Locations and Angled Grout Locations; as shown by symbol to represent an 11×11' Sq. Pattern and a 15'×15' Sq. Pattern. After the grouting, a selected number of SPT and CPT tests were run to measure the soil density after compaction; being located between the points of grout injection. During grouting in Ivanetich, low mobility grout was utilized rather than true compaction grout. This approach, it is submitted, might give a satisfactory result if soil densification was the only result required. However, such grout might well flare off in the soil and not result in true compaction pile shapes.

The results from Ivanetich indicated an overall improvement in the soil properties as measured by the SPT tests.

However, in individual locations, the improvement ranged from a dramatic two (2) times denser to no density improvement at all. As one would expect in this technology, post treatment CPT data paralleled the SPT data. Ivanetich concludes that the average improvement is roughly equivalent to preventing damage by an earthquake measuring 'one' number greater on the Richter scale; i.e., from a Richter 5 to a 6, or 6 to a 7. The Ivanetich work was apparently targeted to mitigate the shock of a Richter 8 earthquake. However, there is no way of telling whether there are meaningful effects from the specific work done. Ivanetich concludes that it may be reasonable to carry out the programs suggested even at the high cost of such work because the risks of not doing it are so great. However, the plausibility of the Ivanetich work based on its inconsistent results would not appear to be justified in relation to the realistic eventuality of the earthquake disaster anticipated in Ivanetich.

Davis and Berrill discuss the relationship of pore pressure increases (p) to dissipated energy (D); and set forth what they reference as a so-called D-p theory. They correlate real data from several earthquakes in the U.S. and Japan to develop correlation constants.

Bonita et al. Deals with soil liquefaction and describes a set of parameters relating to specific sites where ground improvements had been made. There was no implication or recognizance of the phenomenon of seismic shock wave reduction.

Tabesh and Poulos sets forth schematically a conventional arrangement of piles in FIG. 6 of their presentation regarding a pseudostatic approach for seismic analysis of single piles.

Predictive models have advanced rapidly in the last decade. There are presently ways of translating the ground effects of an earthquake of any given magnitude into ground reaction and performance data. This is being done to begin to gauge the effects on building foundations. It is not clear, however, in the prior art, what the best methods are of counteracting building destruction. Modeling of a small scale utilizing a centrifuge has begun in the recent past; and as this approach develops, it should provide a means of experimenting which should prove more effective than any other method in testing the protective earthquake technology structures.

However, at present, none of the patent or publication references found in the prior art specifically illustrate or disclose the angular pile array assembly system for reduced soil liquefaction of the present invention. Nor is the present invention obvious, in this or closely related technologies, in view of any of the prior art references listed. In addition, all of the relevant prior art heretofore known suffer from a number of disadvantages.

A significant shortcoming in the prior art is that it does not offer a system, adequately responsive to seismic disturbances, which appears to, both, provide adequate ground support against liquefaction and also provide the soil with a greater magnitude of density to resist liquefaction.

An additional problem in the prior art is that a suitable protective array of grouting elements positionally placed in the ground soil in relation to a building structure, has not previously been available; nor have the various grouting and pile structures conventionally available been positionally deployed in ground soil adjacent to buildings and other structures to obtain the greatest advantage.

The prior art has further suffered in not providing a ground soil structural support system which adequately takes advantage of the dynamic seismic principles relating to shock wave dissemination, reflection/deflection and dissipation of energy waves underground, during seismic disturbances or earthquakes.

Yet a further problem or defect in the prior art has been the absence of adequate pile, grouting or compaction grouting support for providing better ground support protection against the seismic propagation of lateral or horizontal energy waves, as this relates to the stability of ground soil adjacent or proximate to building, bridge, wharf, pier, highway or roadway structures.

These and other defects, problems and shortcomings of the prior art technology, structurally and functionally, will become apparent in reviewing the remainder of the present specification, claims and drawings.

Accordingly, it is an object of the present invention to provide a novel pile array system which will significantly reduce or lessen seismic shock on the footing of a structure from earthquakes or other occurrences and the related damages to ground structures and buildings.

It is a further object of the present invention to provide a pile array system which will reduce soil liquefaction both by virtue of a novelly positioned structural array support to dissipate seismic shock waves and by the added ground density afforded to a ground site by the installation of such an array system; or, stating this another way, by the invention's use of compaction piles, grouting or other pile or column menas placed in a deflecting array, while densifying the soil at the same time.

It is yet a further object of the present invention to provide a pile array system which is versatile and adoptable to utilizing several significant types of grouting, piles, and stone columns; and which can be used in interaction or association with other soil liquefaction reduction methods.

It is a further object to provide a pile array assembly which can be utilized under a ground structure's foundation or footing, without necessarily being in direct contact with such a structure.

It is a further object to provide a pile array system which will have the capacity of reducing a seismic shock wave by two orders of magnitude; example, from richter scale 7 to 5.

Yet a further object is to provide a pile array system which will best interrupt, deflect and redistribute seismic shock waves so as to significantly lower the intensity of shock wave and reduce or prevent settlement of building and ground structure foundations.

It is yet a further object to provide further enhancements to a soil installation site by virtue of the installation process of the present invention, especially with regard to tolerances and pile member location, adjacent distance to footing and consolidation of adjacent soil; drilling depth in relation to adjacent bedrock or dense soil layers, and pile positioning and placement; and the utilization of arced or arched positional support array configurations to maximize seismic wave deflection and ground site densification.

It will, therefore, be understood that substantial and distinguishable structural and functional advantages are realized in the present invention over the prior art teachings; and that the present invention's novel placement, configuration and array structure; diverse utility in serving at least two or more seismically significant functions contemporaneously; and broad functional applications serve as important bases of novelty and distinction in this regard.

SUMMARY OF THE INVENTION

The foregoing and other objects of the invention can be achieved with the present invention, device, assembly and system which is a pile array assembly system for use in interaction with a ground soil site and footing adjacent to and supporting a ground surface structure of building for reduced soil liquefaction and providing greater ground stability in the event of an earthquake or other seismic disturbance.

The invention is provided with a first array subassembly having a plurality or number of pile units. Each of the pile units have first and second ends and a lengthwise lateral wall extending between these two ends. Each of the piles is positioned and placed, in interaction with a ground soil site, at specific ground entry points so as to extend and slope at a theta-1 angle in relation to an imaginary vertical axis defined and extending from each of the respective entry points. By positioning in this manner, the first ends of each of the respective pile units are generally positioned and placed so as to define, when imaginary interconnecting periphery lines are attached thereto, a first perimeter. The second ends of each of the respective pile units are positioned and placed so as to define, when imaginary interconnecting periphery lines are attached thereto, a second perimeter which is greater in dimensional magnitude than that of the first perimeter. A first positional axis is defined between the first and second ends extending between the first perimeter and the second perimeter as to each of the respective pile units of the first array subassembly.

The invention is further provided with a second array subassembly having a number of pile units. Each of the pile units have first and second ends and a lengthwise lateral wall extending between these two ends. Each of the piles is positioned and placed, in interaction with a ground soil site, at specific ground entry points so as to extend and slope at a theta-2 angle in relation to an imaginary vertical axis defined and extending from each of the respective entry points. By positioning in this manner, the first ends of each of the respective pile units are generally positioned and placed so as to define, when imaginary interconnecting periphery lines are attached thereto, a third perimeter. The second ends of each of the respective pile units are positioned and placed so as to define, when imaginary interconnecting periphery lines are attached thereto, a fourth perimeter which is greater in dimensional magnitude than that of the third perimeter. A first positional axis is defined between the first and second ends extending between the third perimeter and the fourth perimeter as to each of the respective pile units of the second array subassembly.

The invention is further provided with a third array subassembly having a number of pile units. Each of the pile units have first and second ends and a lengthwise lateral wall extending between these two ends. Each of the piles is positioned and placed, in interaction with a ground soil site, at specific ground entry points so as to extend and slope at a theta-3 angle in relation to an imaginary vertical axis defined and extending from each of the respective entry points. By positioning in this manner, the first ends of each of the respective pile units are generally positioned and placed so as to define, when imaginary interconnecting periphery lines are attached thereto, a fifth perimeter. The second ends of each of the respective pile units are positioned and placed so as to define, when imaginary interconnecting periphery lines are attached thereto, a sixth perimeter which is greater in dimensional magnitude than that of the fifth perimeter. A first positional axis is defined between the first and second ends extending between the fifth perimeter and the sixth perimeter as to each of the respective pile units of the third array subassembly.

The present invention further comprises a fourth array subassembly having a number of pile units, with each of the piles having first and second ends and a lengthwise lateral wall extending between the two ends. Each of the pile units are positioned and placed in interaction with a ground soil site at specific ground entry points generally proximal and along the fifth perimeter at points between the respective pile units of the third array so as to extend at a gamma angle in relation to an imaginary vertical axis extending from each of the respective entry points, so that the first ends of each of the respective pile units are generally positioned and placed generally proximal and along the fifth perimeter and the second ends of each of the respective pile units are generally positioned and placed so as to define, when imaginary interconnecting periphery lines are attached thereto, a seventh perimeter which is of less dimensional magnitude than that of the third perimeter.

REFERENCE NUMBERS

Figure 1:
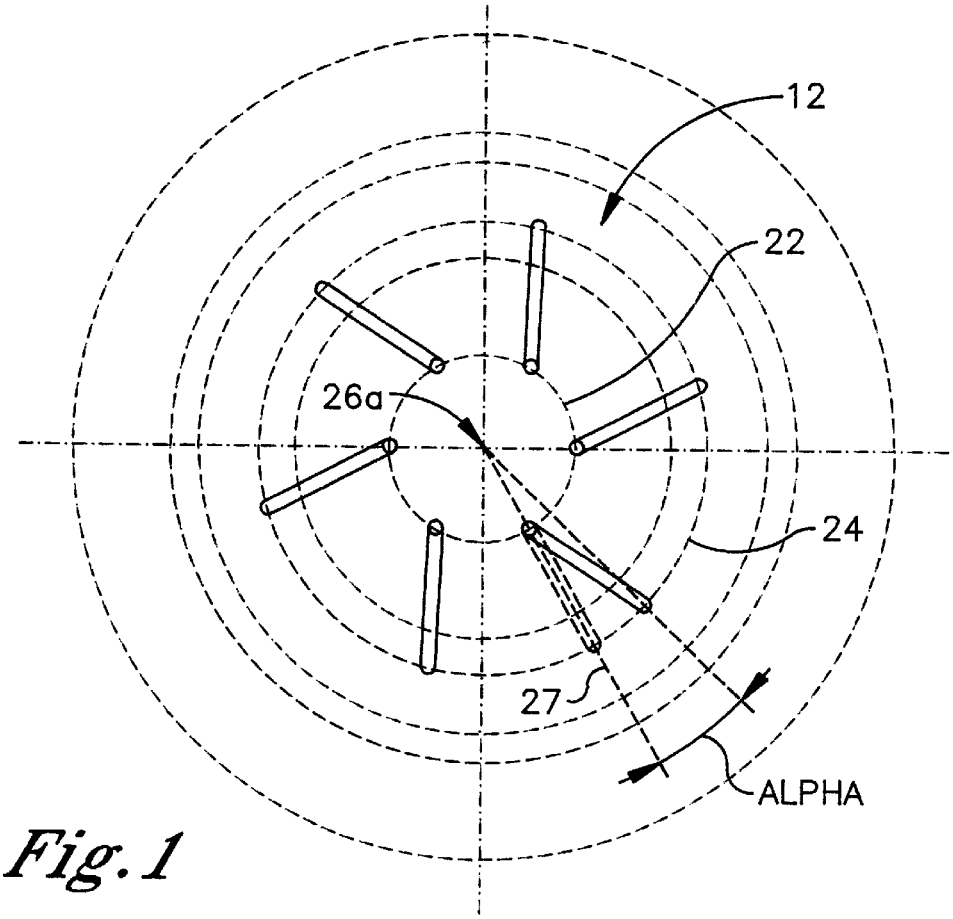
FIG. 1 is a top view of the first array subassembly forming part of a preferred embodiment of the present invention for clarity in illustrating the separate individual installation of a number of array subassemblies of the invention. The straight crossing broken lines being utilized to illustrate a centre point of the circular periphery lines. Additional broken lines illustrate, by example, a first positional axis of one of the pile members, and the alpha angle of offset of the second end of the pile member.

10 Pile Array Assembly System or "Array"
12 first array subassembly
14 pile member(s) of (12)
16 first end(s) of (14)
18 second end(s) of (14)
20 lengthwise lateral wall(s)
22' imaginary interconnecting perimeter lines (shown as broken lines in FIGS. 1A, 1,2,9,10,11,12 and 13)
22 first periphery
24' imaginary interconnecting perimeter lines (shown as broken lines as indicated above)
24 second periphery
26*a* centre point of (22)(40)(54)
26*b* centre point of (24)(42)(56)
26*c* vertical axis between (26*a*) and (26*b*)
theta angle of first positional axis (27)(43)(58)
alpha angle of circular advancement, spin or movement of second ends (18) along second periphery (24); and second ends (50) along the sixth periphery (56)
30 second array subassembly
32 pile members of (30)
34 first end of (32)
36 second end of (32)
38 lengthwise lateral wall of (14)
40' imaginary interconnecting perimeter lines
40 third periphery
42' imaginary interconnecting perimeter lines
42 fourth periphery
43 first positional axis of (32)
44 third array subassembly
46 pile members of (44)
48 first end of (46)
50 second end of (46)
52 lengthwise lateral wall of (46)
54' geometrical, imaginary interconnecting perimeter lines
54 fifth periphery
56' imaginary interconnecting perimeter lines
56 sixth periphery
58 first positional axis of (46)
60 fourth array subassembly
62 pile members of (60)
64 first end of (62)
66 second end of (62)
68 lengthwise lateral wall of (62)
70' imaginary geometrical perimeter or arc lines
70 seventh periphery
71 first positional axis of (62)
80 ellipsoid array orientation (another preferred embodiment)
76 fifth array subassembly
gamma Angle of first positional axis (71)

DETAILED DESCRIPTION OF THE PREFERRED EMBODIMENTS OF THE INVENTION

The following description of the preferred embodiments of the concepts and teachings of the present invention is made in reference to the accompanying drawing figures which constitute preselected illustrated examples and schematic representations of the elements of the present invention, among many other examples existing within the scope and spirit of the present invention.

Referring now to the drawings, FIGS. 1A through 15, and 18, thereof; there is shown a Pile Array Assembly System 10 of the present invention, referred to herein as the Array 10.

The Array 10 is utilized in providing reduced soil liquefaction. In this regard, the Array 10 is utilized in interaction with ground soil through installation of the present invention at, or within, a ground site which is adjacent or proximate to footing or other preselected foundational support or architectural structures associated with ground surface buildings or other structures such as bridges, highways, road overpasses, piers, wharfs or like structures ultimately supported by ground or underwater ground surfaces; or in interaction with other areas adjacent or proximal to areas that may be subject to seismic or underground shock waves or disturbances. It will be understood by those skilled in the art that there will be many ways in which the invention can be installed at such a ground site, and many diverse methods of providing grout, compaction piling, other types of piling, or stone columns, etc. as a part of installing the present invention within the concepts of its unique array system; and that various different dimensions of such respective grout, piling or columns as to respective pile units or members can be utilized; although some dimensions, for exemplar purposes only, will be suggested, later herein, among a number of such practical dimensioning that can be utilized in practicing the concepts of the invention while adapting to special ground site circumstances.

The Array 10 is provided in a preferred embodiment with a first array subassembly 12. The first subassembly 12 comprises from about 5 (five) pile members (14) to about 7 (seven) pile members (14); and is illustrated, by example only, as containing 6 (six) pile members 14 in one preferred embodiment in FIGS. 1A, 1, 2, 9, 10, 11, 12 and 13. Each of the pile members 14 is provided with the first and second ends 16 and 18, respectively, and the lengthwise lateral wall 20 extending between and structurally connecting the first and second ends 16 and 18.

As illustrated, the first end 16 of each of the respective pile members 14 is generally or substantially positioned and placed so as to define or create, when imaginary interconnecting perimeter (or arc) lines (22') are attached or connected between the first ends 16, the first periphery 22 which is generally circumferential or circularly round in configuration; as shown by broken circular lines used for illustration purposes in FIGS. 1A, 1, 2, 9, 10, 11, 12 and 13; with regard to peripheries of the first array subassembly 12 discussed herein.

The second end 18 of each of the respective pile members 14 is positioned and placed so as to create, when imaginary interconnecting perimeter lines (24') are connected between the second ends 18, the second periphery 24, which is also circumferential in configuration, by example, as illustrated.

As illustrated by example, the second periphery 24 is greater in dimensional magnitude; i.e., through circumferential distance (or radian distance), area, radius or diameter; than such dimensional magnitude of the first periphery 22. The first and second peripheries also define and share, substantially or generally, the same basic centre points 26*a* and 26*b*, geometrically. Also, as illustrated, the vertical axis 26*c* connects the centre points; each of the two peripheries 22 and 24 represents (or is illustrated along) a separate horizontal axis; and each of the first and second peripheries, respectively, 22 and 24 is spaced from one another.

Figure 2:
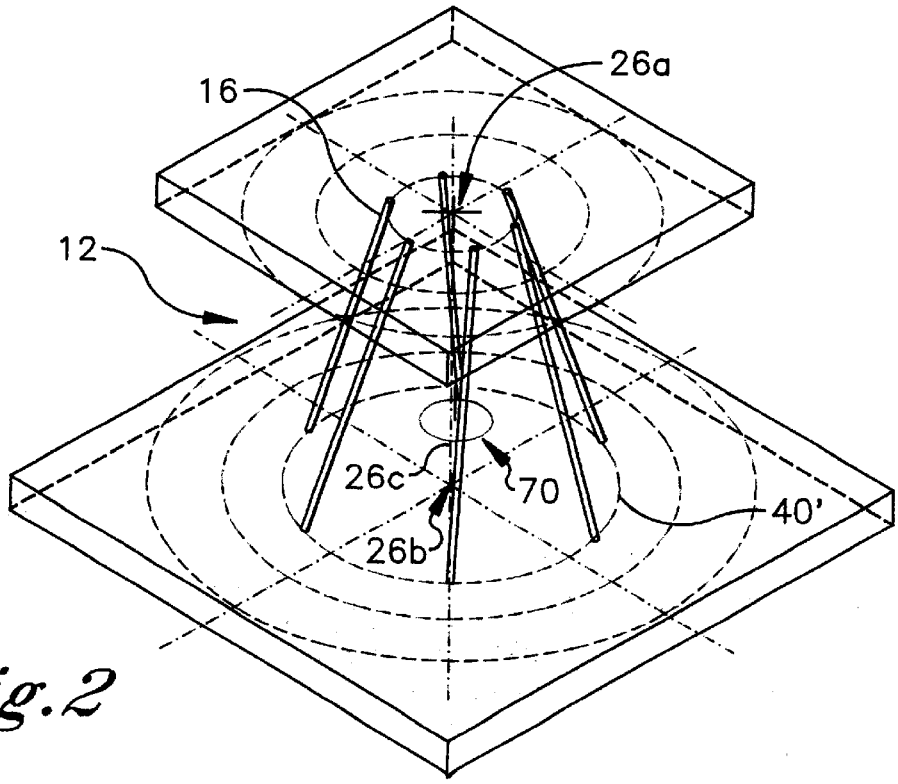
FIG. 2 is an elevated perspective view of part of the present invention illustrated in FIG. 1. The hovering circle above bottom center illustrates the position of the seventh periphery of a preferred embodiment; the top and bottom shelf representations in solid and broken lines schematically represent respective horizontal axes; and the additional broken vertical line in perspective connects the common centre points of the peripheries.
Figure 2A:
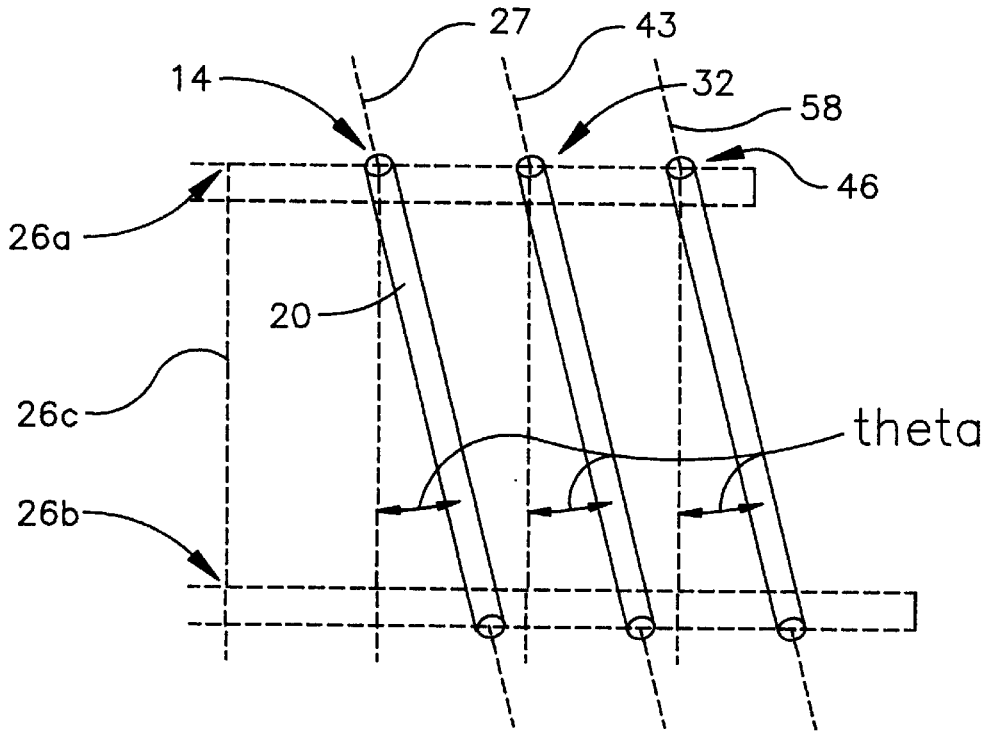
FIG. 2A is a schematic exemplar side view of pile members from respective array subassemblies and peripheries illustrating, by example, the theta angle as respective pile members extend from one periphery to another periphery.

The first positional axis 27 is defined or created along each pile member 14 as it extends along this axis between the first periphery 22 and the second periphery 24, as originally positioned. This is shown by example in FIG. 1 in the broken-lined example of one pile unit, prior to spin or offset. It is within the scope and spirit of the present invention to provide the first array subassembly 12 having all or part of its number (plurality) of pile members 14 extending between the first and second peripheries 22 and 24 (as shown by example in FIG. 2A) without spin, twist, skew, added circular or positional advancement, or offset, from this original point of positioning. However, FIGS. 1 and 2, as well as other drawing figures herein, also illustrate a preferred embodiment of the invention in showing each of the respective second ends 18 of the pile members 14 being positionally and circularly advanced, moved, spun or offset along the second periphery at an alpha angle.

In this regard, in preferred embodiments, the theta angle is equal to from about 12 (twelve) degrees to about 20 (twenty) degrees in relation to the vertical axis 26*c* between the centre points 26*a* and 26*b*; and is preferably about 15 (fifteen) degrees.

The alpha angle in preferred embodiments is equal to from about 2 (two) degrees to about 20 (twenty) degrees in relation to the vertical axis created or defined by the placement of the respective first ends 16 of the pile members 14; and from about 6 (six) degrees to about 10 (ten) degrees, with 8 (eight) degrees being preferred, when the alpha angle is measured in relation to the vertical axis 26*c* of the centre points.

Figure 16:
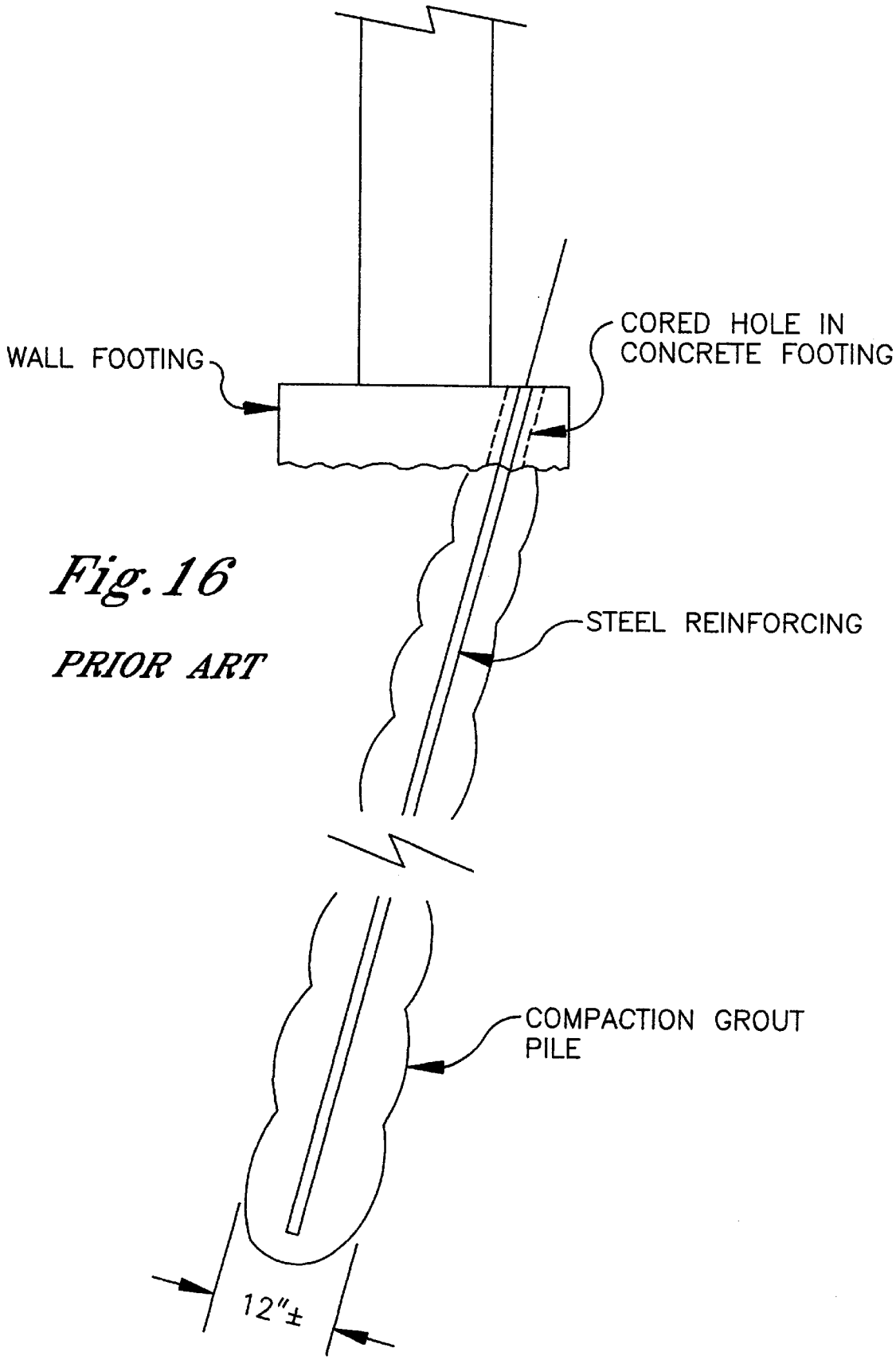
Fig. 16 PRIOR ART
FIGS. 16 AND 17 are schematic representations illustrating prior art use of examples of compaction grouting.
Figure 17:
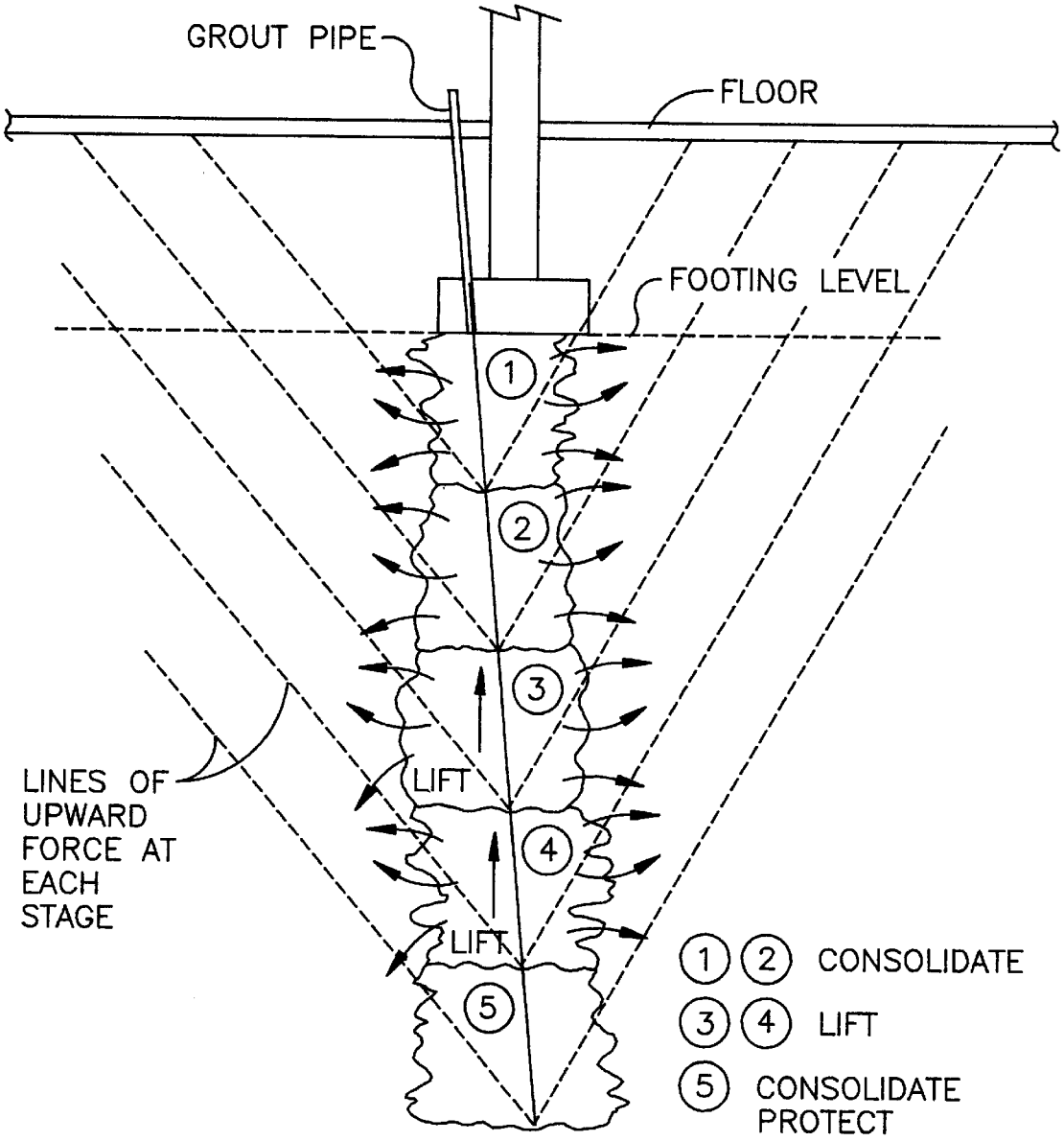
Fig. 17 PRIOR ART

As discussed in part earlier, it is a significant advantage of the present invention's pile Array lo in being able to utilize as part or all of the pile members or units of the invention's array subassemblies described herein; or in combination with one another; various and diverse types of pile, grout, column or similar support means. For example, such utilization and choice can be selected from a group including support means such as mine-piles, resistant rigid piles, compaction/compaction grout piles (shown by example in FIG. 16), "H" piles, "I" piles, piles with internal steel or metal support; concrete, alloy, polymer, composite, metal and/or steel piles; and pile subsections fabricated, poured or structured so as to define and have a number of lateral extensions (or peaks and valleys), as shown by example in FIG. 17.

The Array 10 is further provided with the second array subassembly 30; which, in preferred embodiments, is provided with from about 12 (twelve) pile members (32) to about 14 (fourteen) pile members, and preferably 13 (thirteen) pile members (32); as illustrated by example in FIGS. 1A, 5, 6, 9, lo, 11, 12 and 13. Each pile 32 is provided with its first end 34, second end 36 and lengthwise lateral wall 38.

Figure 5:
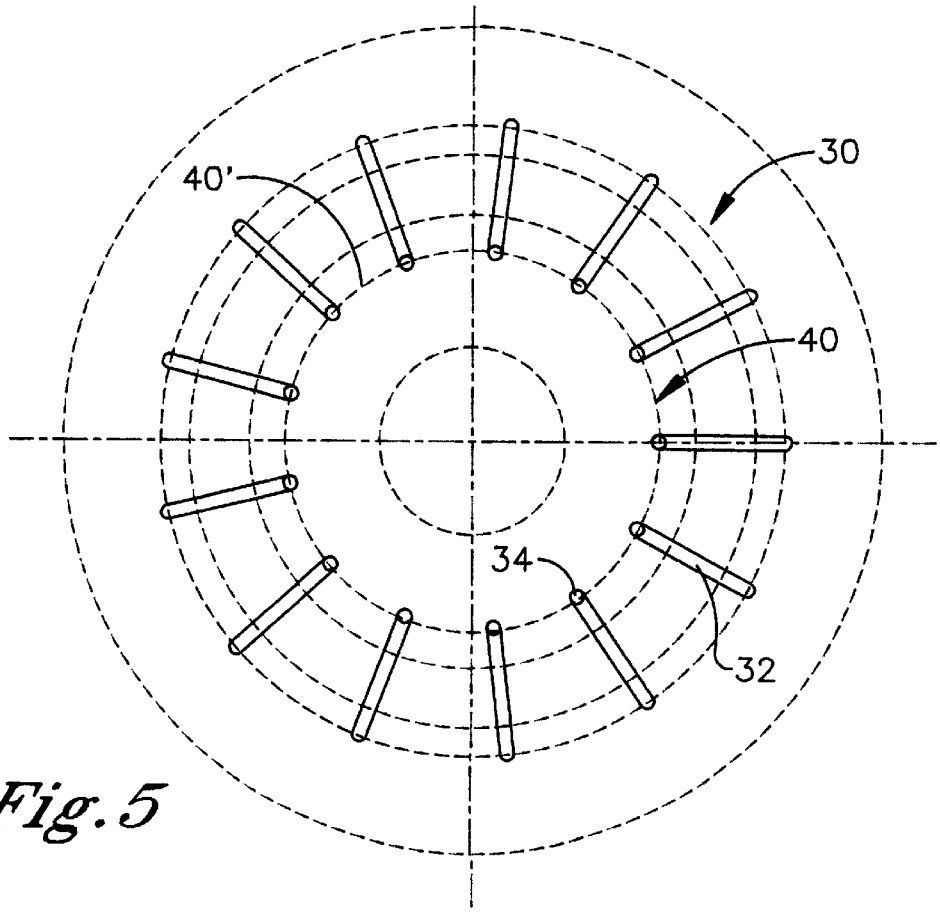
FIG. 5 is a top view of the second array subassembly forming part of the preferred embodiment of the present invention illustrated in FIG. 1.
Figure 6:
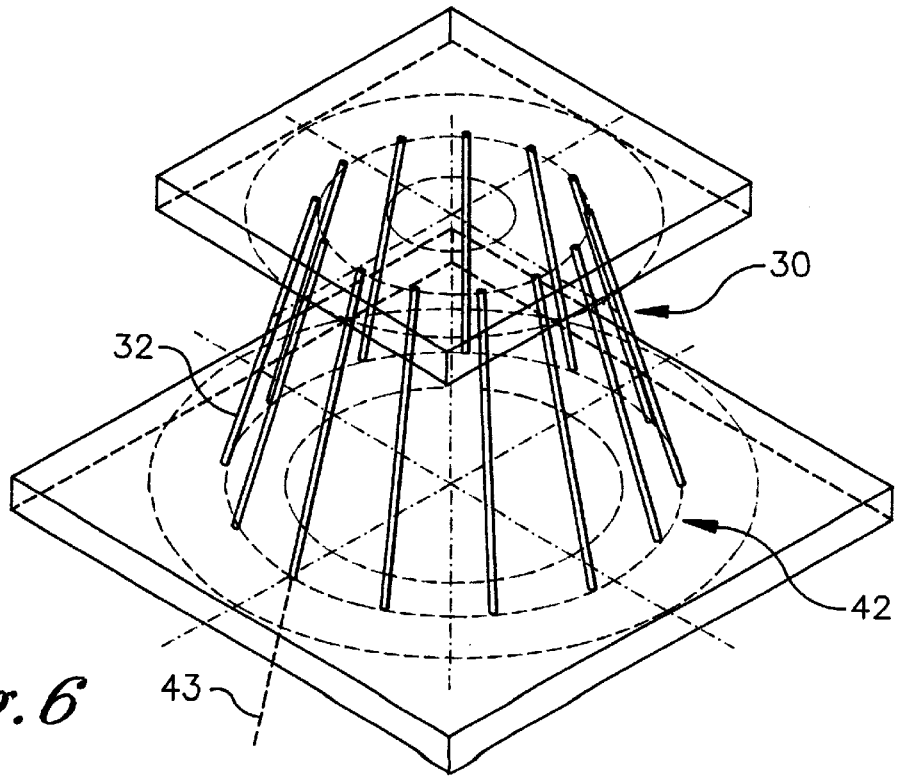
FIG. 6 is an elevated perspective view of part of the invention illustrated in FIG. 5.

The first ends 34 of the pile members 32 are positioned and placed in or at a ground installation site, with which the present invention is designed to interact, so as to create, when imaginary interconnecting perimeter lines 40; are connected between the first ends 34, the third periphery 40, which is circumferential in configuration, as shown by illustration in FIGS. 5 and 6 and the other drawing figures referenced.

The second end 36 of each of the pile members 32 is positioned and placed so as to create, when imaginary interconnecting perimeter lines 42' are connected between the second ends 36, the fourth periphery 42, which is also circumferential in configuration.

The fourth periphery 42 is greater in dimensional magnitude than that of the third periphery 40, as illustrated by example. The third and fourth peripheries also share the same centre points 26*a* and 26*b*, geometrically, by virtue of the connecting, spaced vertical axis 26*c*. The first positional axis 43 is created along each pile member 32 as it extends along this axis between the third periphery 40 and the fourth periphery 42. The first positional axis 43 extends, in preferred embodiments, at the theta angle, earlier discussed; and is preferably 15 degrees in relation to the vertical axis 26*c* of the center points 26*a* and 26*b*. Additionally, in preferred embodiments there is no circular advancement, spin, positional placement or offset at the second ends at the alpha angle, as described in reference to the first array subassembly 12 and the second ends 18 of its pile members 14 therein. However, it will be understood within the scope of the present invention that the alpha angle off-set can be employed with regard to the final positional placement of the second ends 36 of the pile members 32 of the second array subassembly 30.

The Array 10 is also provided, in preferred embodiments, with the third array subassembly 44. The subassembly 44 is provided with at least about 18 (eighteen) pile members 46; and preferably about 20 (twenty) pile members, as illustrated by example in FIGS. 1A, 7, 8,9, 10, 11,12 and 13. The pile members 46 are provided with the first end 48, the second end 50 and the lengthwise lateral wall 52. The first ends 48 are positioned and placed so as to create, when geometrical imaginary interconnecting perimeter lines 54' are connected between the first ends 48, the fifth periphery 54. The second ends 50 are positioned so as to create, when imaginary interconnecting perimeter lines 56' are connected between the second ends 50, the sixth periphery 56; which is greater in dimensional magnitude than that of the fifth periphery, and shares with it the same centre points 26*a* and 26*b*, connected by their spaced, vertical axis 26*c*.

Figure 7:
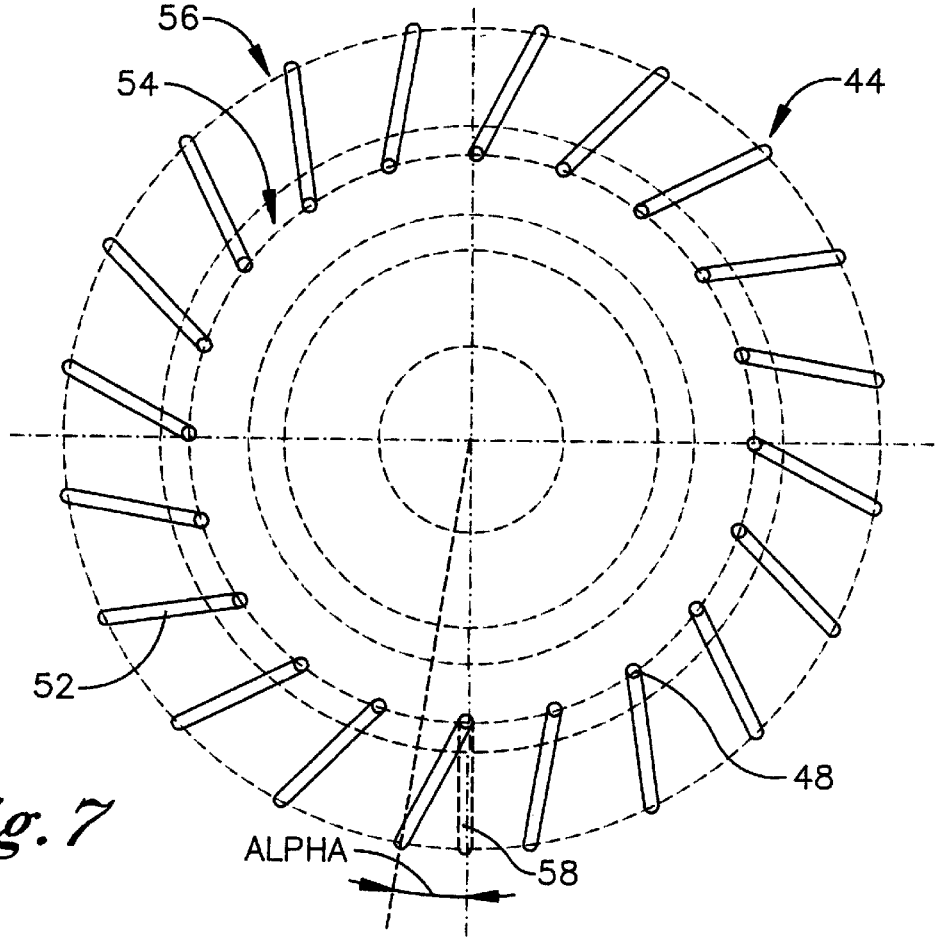
FIG. 7 is a top view of the third array subassembly forming part of the preferred embodiment of the invention as illustrated in FIG. 1.
Figure 8:
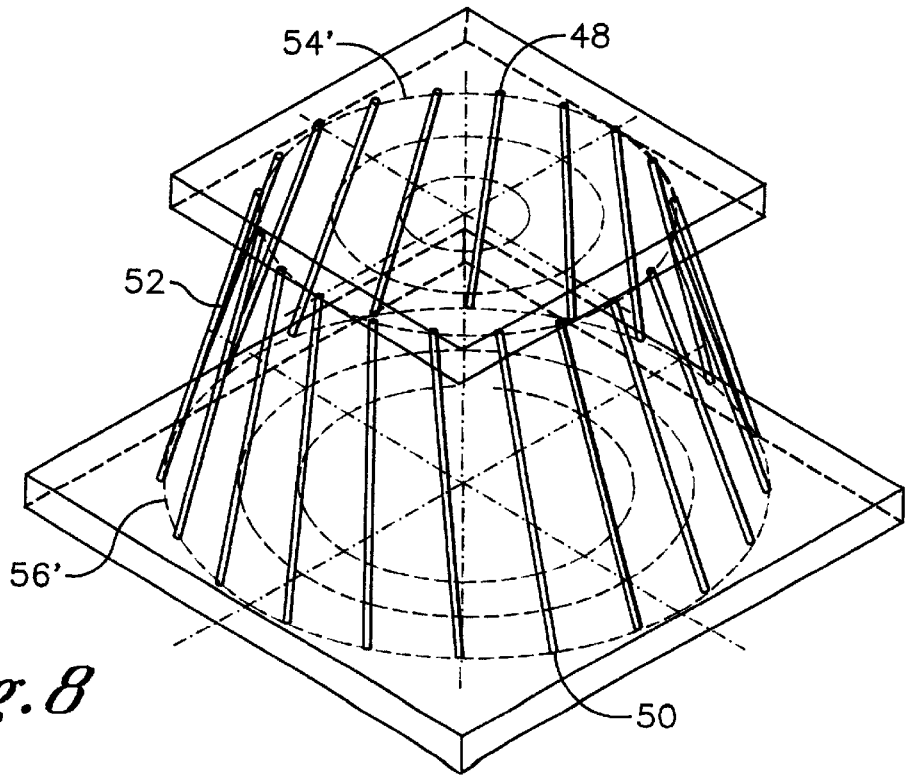
FIG. 8 is an elevated perspective view of part of the present invention illustrated in FIG. 7.
Figure 9:
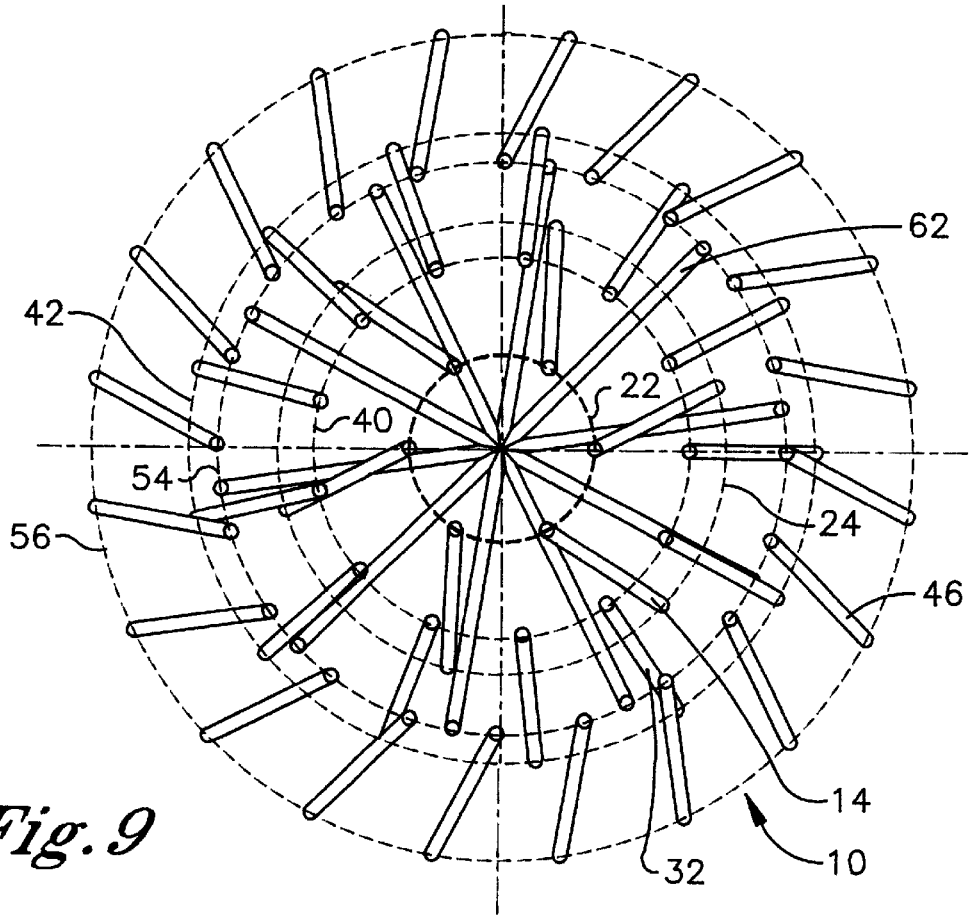
FIG. 9 is a top view of the preferred embodiment illustrated in FIGS. 1 through 8, illustrating all of the array subassemblies previously illustrated in position at the same time.
Figure 10:
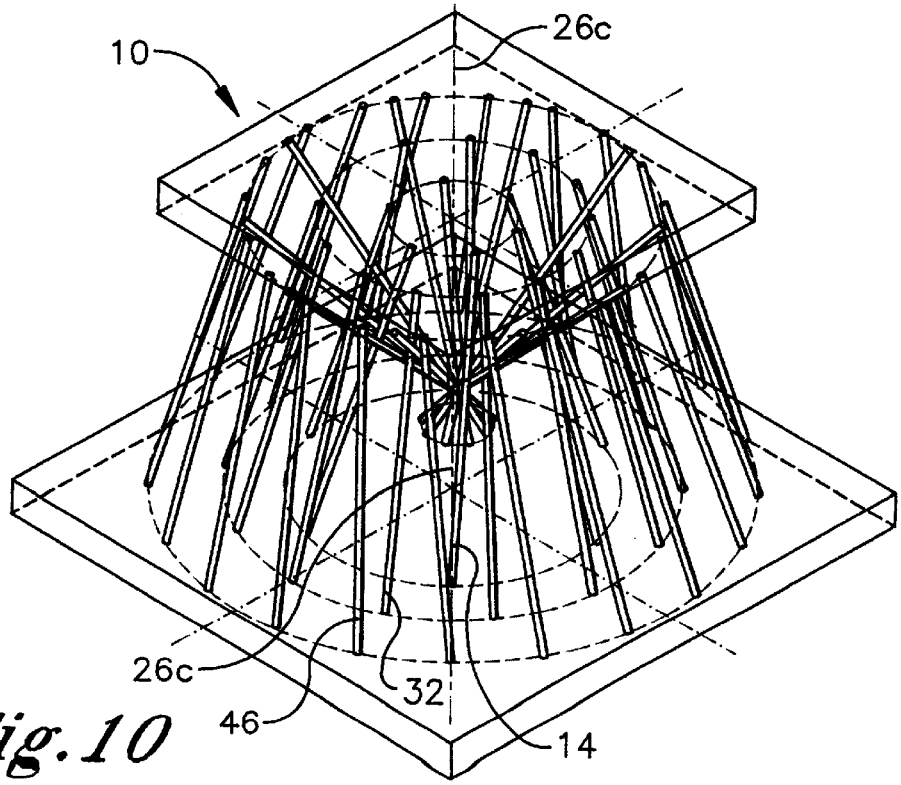
FIG. 10 is an elevated perspective view of the preferred embodiment of the invention illustrated in FIG. 9.
Figure 11:
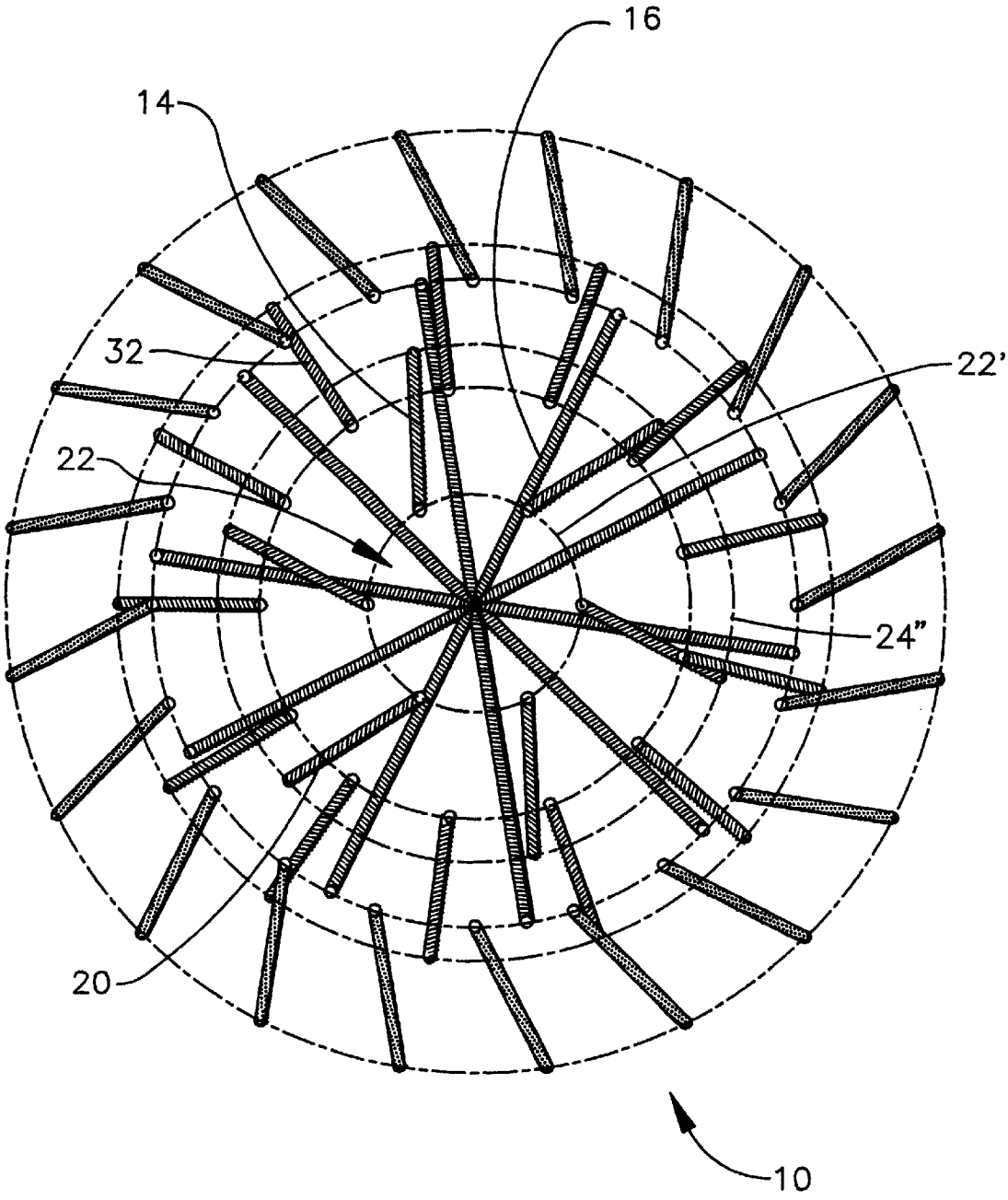
FIG. 11 is a top view of the novel Pile Array Assembly System For Reduced Soil Liquefaction of the present invention; the six circular periphery configurations being set forth with broken lines illustrating by superimposed arc or perimeter lines; from center to furthermost outside line; the first, third, second, fifth, fourth and sixth peripheries of a preferred embodiment of the invention. Various aspects of these lines are also shown in FIGS. 1 through 13, and FIG. 18, along one or more axes.
Figure 12:
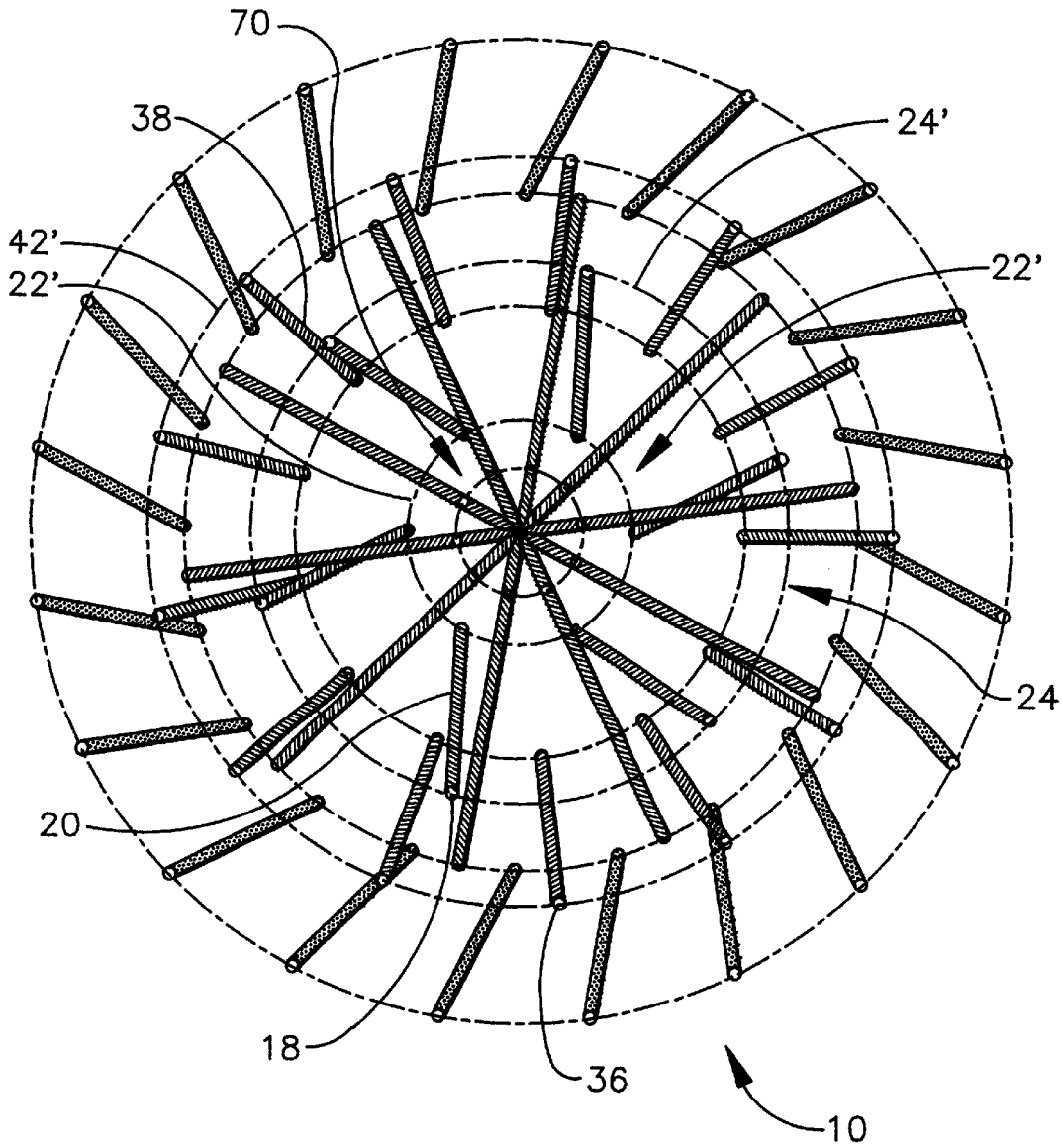
FIG. 12 is a bottom view (or sub-ground, underground view, looking up) of the preferred embodiment of the present invention illustrated in FIGS. 1A and 11.
Figure 13:
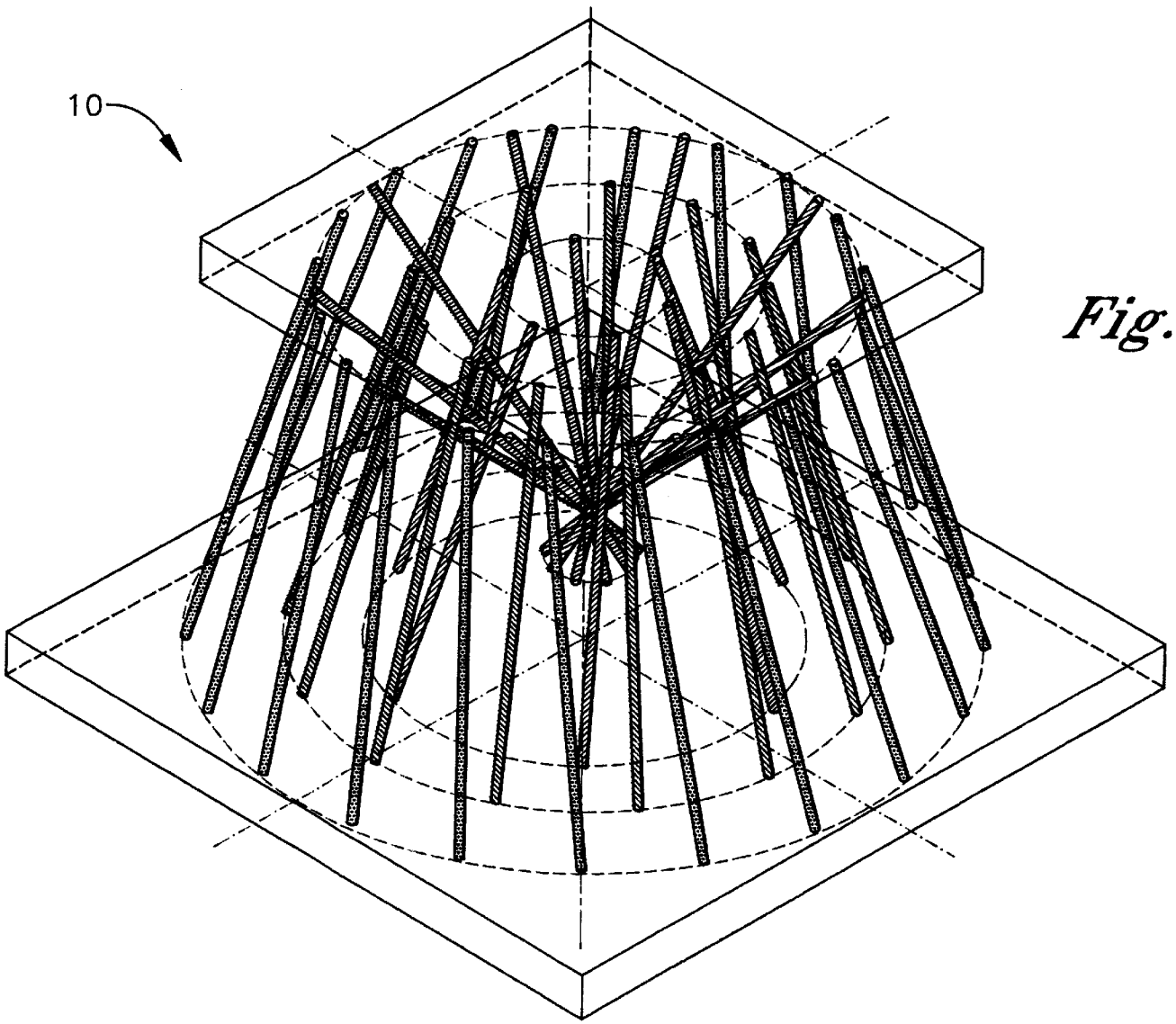
FIG. 13 is an elevated perspective view of the embodiment of the invention illustrated in FIGS. 1A, 11 and 12. The solid lines schematically representing the horizontal axes discussed in relation to FIG. 2.

The first positional axis 58 of the pile members 46 extends, as an imaginary axis line, along each pile 46 as it extends from the first end 48 positioned on the fifth periphery 54; to the second end 50, positioned on the sixth periphery 56. The axis 58 extends at the theta angle, preferably at about 15 degrees in relation tot eh vertical axis 26*c* of the centre points 26*a* and 26*b*. As illustrated in FIGS. 7 AND 8 (and other drawing figures), each of the second ends 50 of the piles 46 is arcuately or circularly advanced for final positioning along the sixth periphery 56 at the angle alpha, equal to about 8 degrees in relation to the vertical axis 26*c*, while maintaining the first ends 48 in their original position along the fifth periphery 54. This is similar to the final positioning steps of the second ends 18 of the piles 14 as described in reference to the first array subassembly; except that, preferably, the second ends 50 are circularly or otherwise advanced in a geometrical direction generally opposite to the directional advancement or offset of the second ends 18 of the piles 14. It will be understood under the scope and spirit of the Array 10 of the present invention that this final positioning step, in the process of installing the third array subassembly 44 of the Array 10 at a ground site, can be omitted, leaving each, or a majority, of the piles 46 in their original position, installed along the first positional axis 58 at the theta angle between the fifth and sixth peripheries 54 and 56, without additional offset or arcuate advancement.

Figure 3A:
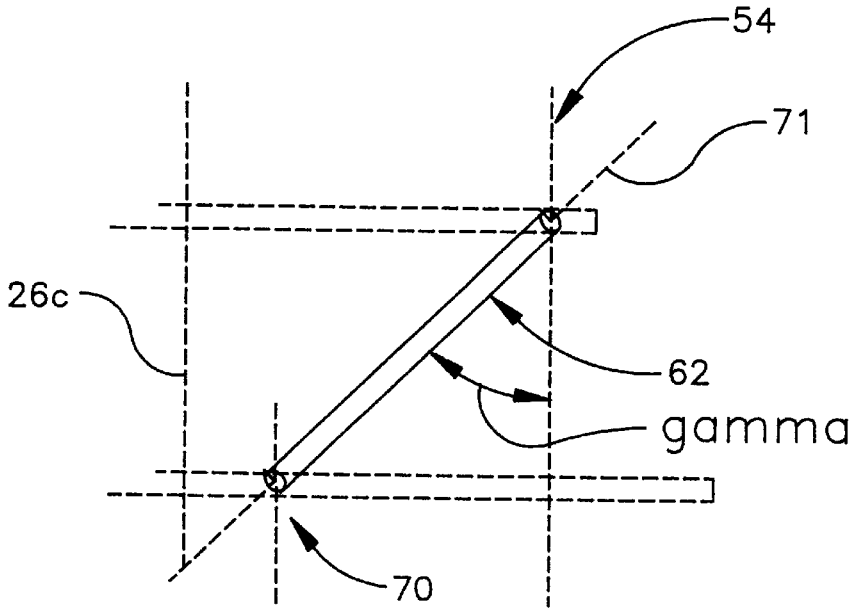
FIG. 3A is a schematic exemplar side view of a pile member from the fourth array subassembly of the invention illustrated in FIG. 3, illustrating the gamma angle as one pile unit extends from one periphery to another.
Figure 3:
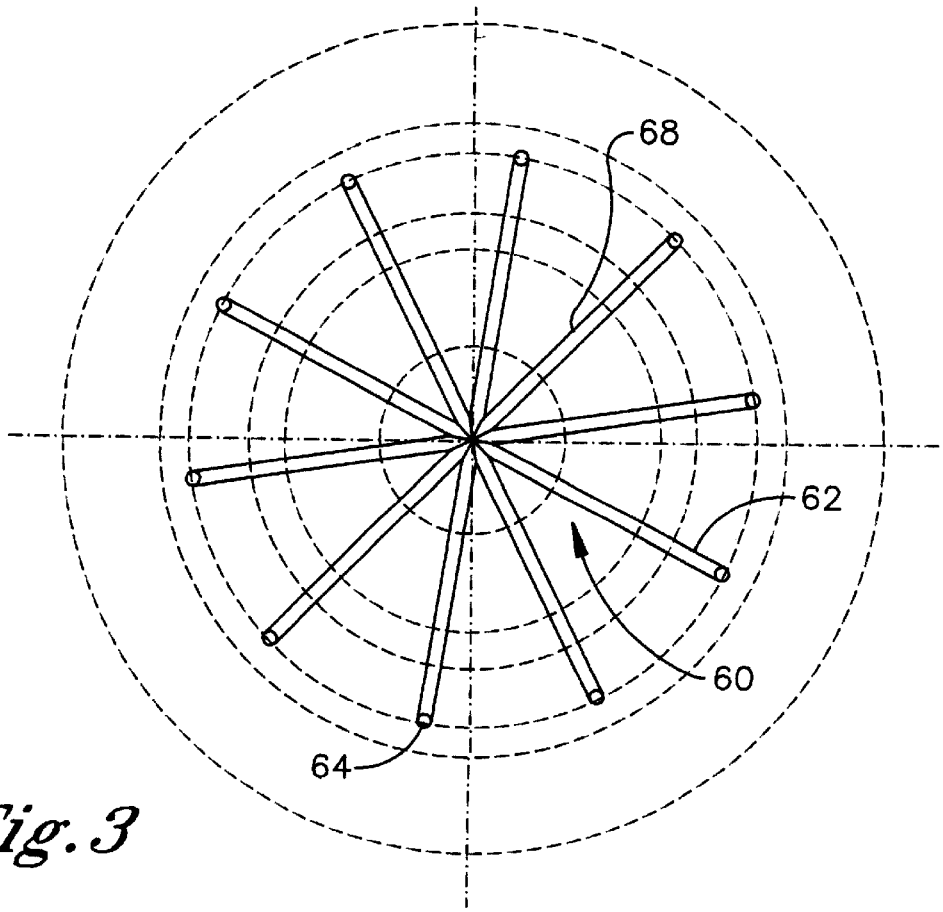
FIG. 3 is a top view of the fourth array subassembly forming part of the preferred embodiment illustrated in FIG. 1
Figure 4:
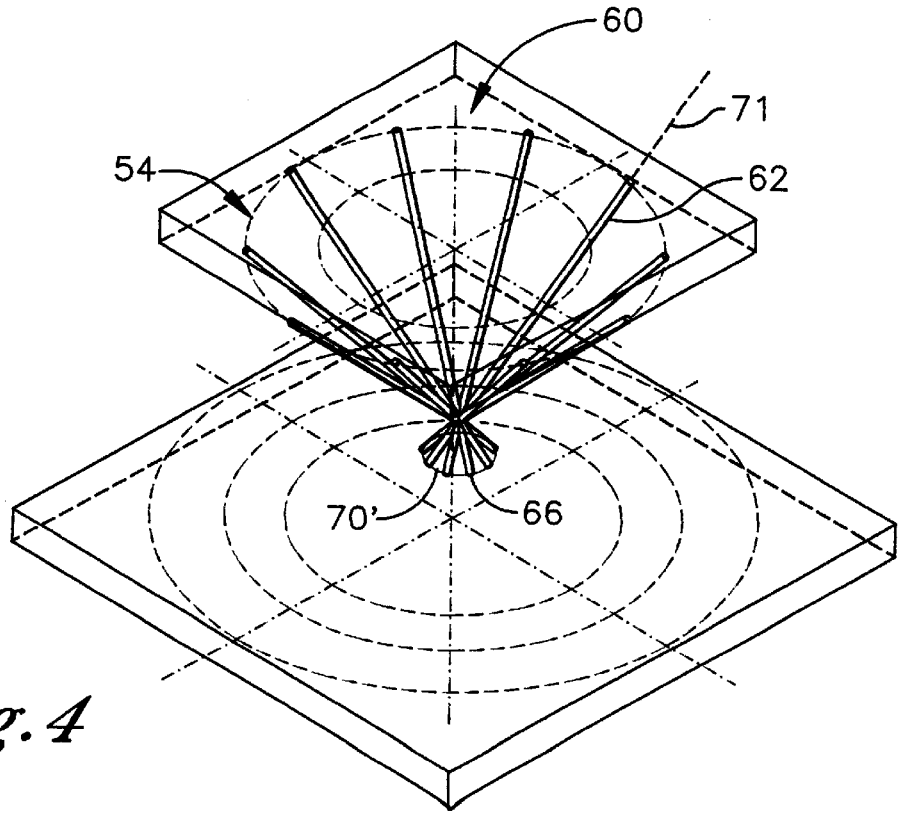
FIG. 4 is an elevated perspective view of part of the present invention illustrated in FIG. 3. The hovering circle representing the seventh periphery, as seen in FIG. 2, now showing placement and positioning of the pile members of the fourth array subassembly.

The Array 10 is further provided, in preferred embodiments, with the fourth array subassembly 60 which comprises preferably about 10 (ten) pile members 62; but in other preferred embodiments within the scope of the invention, can be provided with from about 8 (eight) to about 12 (twelve) pile members 62; as illustrated in FIGS. 3 and 4 and other drawing figures referenced. Each of the piles 62 is provided with the first end 64, the second end 66 and the spaced, lengthwise lateral wall 68 connecting between the ends 64 and 66. This designation has been followed throughout the description herein because most pile, grout or column (etc.) means within the technology will be capable of reasonable minimum description in this manner. Most will be provided with at least first and second ends with interconnecting lateral or lengthwise walls of some type; and the availability in this basic geometrical arrangement will enable the novel positioning and configurational array of the present invention. It will be understood, however, within the scope of the invention that other pile configurations may be utilized, and that the concepts of the present invention, or their equivalents, can otherwise be adapted and employed as described herein.

The first ends 64 of each, or a majority, of the piles 62 are positioned on or along the already existing fifth periphery 54, discussed above, placing the first ends 64 between (or adjacently between) the first ends 48 of the piles 46 of the third array subassembly 44, already in position as described above (or contemporaneous with putting them in position); and as illustrated by example in preferred embodiments in FIGS. 1A, 9, 11, 12 and 13. The respective second ends 66 of the piles 62 are positioned and placed, in interaction and installment within a ground site; so as to create, when imaginary geometrical perimeter or arc lines 70' are attached between the ends 66, the seventh periphery 70 which is of less dimensional magnitude than that of the fifth periphery 54, as illustrated by example in FIGS. 2A, 3 and 4. In other related preferred embodiments within the scope of the invention, the seventh periphery 70 will be of less dimensional magnitude then that of the first periphery 22 of the first array subassembly 12, as also shown by example in FIGS. 1A, 9, 10, 12 and 13.

The first positional axis 71 of the piles 62 extends, as a geometrical imaginary axis line along each, or a majority of, pile members 62 as the pile 62 extends from its first end 64, positioned on the fifth periphery 54; to its second end 66, positioned on the seventh periphery 70. The axis 71 extends at the gamma angle, equal to from about 30 (thirty) degrees to about 60 (sixty) degrees in relation to the centre points 26*a* and 26*b* or its vertical axis 26*c*; or an imaginary geometrical line established for installation purposes which is parallel to vertical axis 26*c*. Preferably gamma angle is equal to about 45 (forty-five) degrees, as is generally illustrated by example in FIG. 3A and the FIGS. referenced. It will be understood within the scope of the present invention that the first ends 64 of the piles 62 can be positioned and installed so as to create a separate new additional periphery, or as part of one of the earlier described preexisting peripheries such as 22, 24, 40, 42 and 56.

Within the installation process of the Array 10, where the sub-ground layers, media or strata formation permits, the pile members 14, 32 and 46, respectively, of the first, second and third subassemblies 12, 30 and 44 are positioned and installed in the ground so that they each extend a depth of at least about 25 feet. It will be understood by those skilled that encountering rock deposits or very firm or packed soil strata will necessitate shortening of the length or dimensions of the pile, grout or column, etc. being utilized. Also, in preferred embodiments, the pile members 62 of the fourth array subassembly 60 extend a depth, when installed at a ground site, in association with the piles of the other subassemblies, which is generally equal to about half of the depth (or average depth) of the pile members of the first, second and third subassemblies 12, 30 and 44.

Also, as illustrated by example in FIGS. 1A, 3, 4, 9, 10, 11, 12 and 13; the positional relationship or orientation of the pile members 62 can vary somewhat in installation placement at, or in interaction with, a sub-ground site. As shown, in this regard, the individual pile members 62 cross, intersect, or intersect within a common area, prior to the respective second ends 66 forming, defining or creating the seventh periphery 70. This aspect is described and illustrated in this manner because the exact position of pile placement of the fourth array subassembly 60 will depend on the sub-ground site conditions and the exact nature and specifications of the fabrication or construction materials used in producing the piles 62. Depending on these parameters, a tighter/closer or more spread out positioning of the piles 62 (within a common area) will be realized prior to, or as a part of, the final placement and positioning of the second ends 66 to produce or create the seventh periphery 70; and this will also affect the positional configuration, shape or orientation of the periphery 70 as the ends 66 are finally positioned.

Additionally, in preferred embodiments, the placement and positioning of pile members within a respective array subassembly (12, 30, 44 and 60) will be such so as to establish a spacing of piles within a given subassembly of from about 1 (one) foot to about 8 (eight) feet, with one to three (1–3) or five (5) feet being preferred when ground site conditions permit this spacing.

Figure 14:
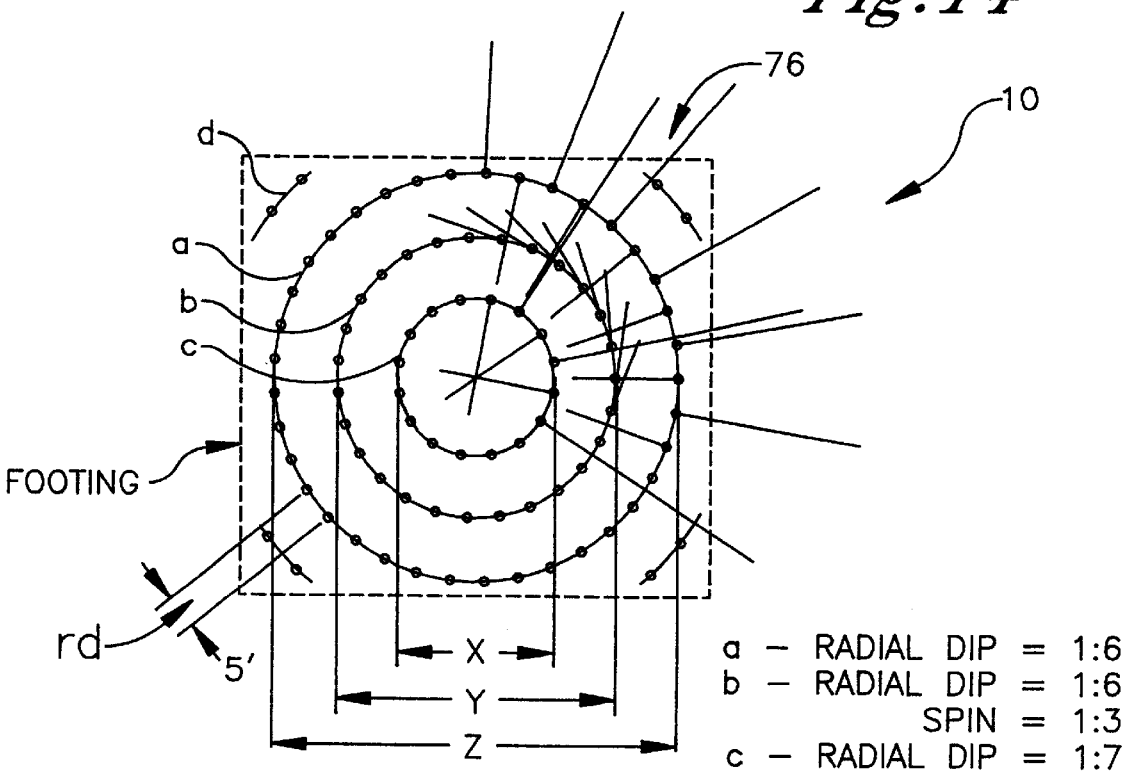
FIG. 14 is a schematic top view representation of another preferred embodiment of the present invention.
Figure 15:
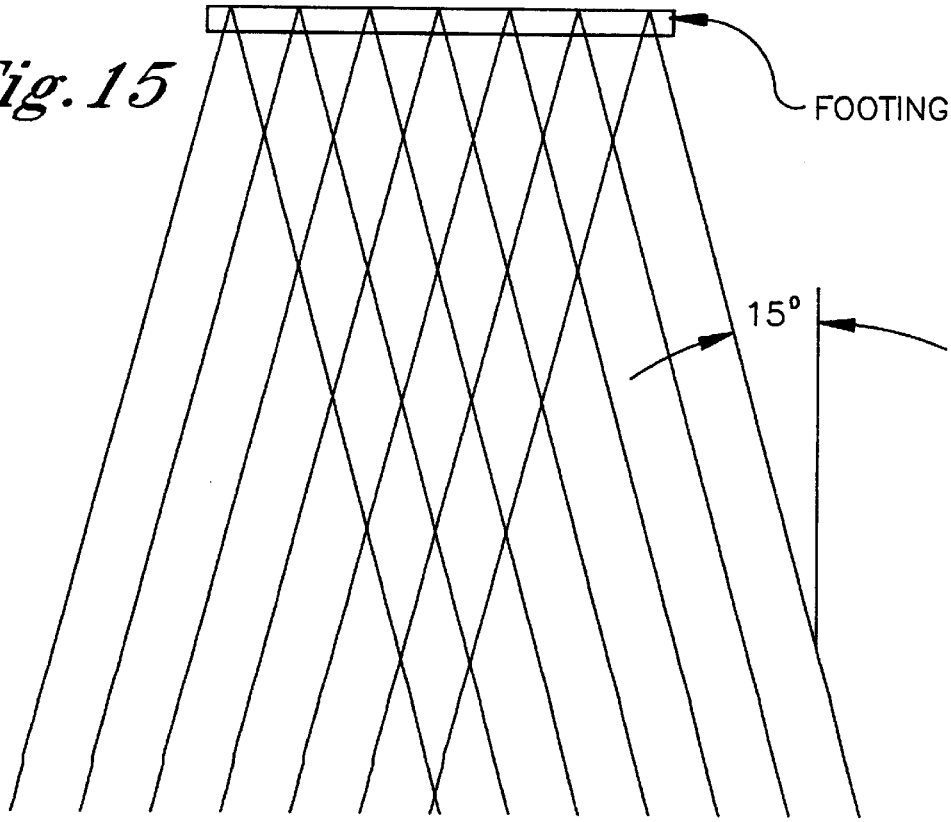
FIG. 15 is a schematic representation of a portion of a preferred embodiment of the invention illustrating a theta angle of slope utilized with an array of pile members used in the present invention.

With regard to FIG. 14, one preferred embodiment is illustrated by example when "x" equals 10 (ten) feet (or comparative or equivalent units), "y" equals 20 (twenty) feet, and "z" equals 30 (thirty) feet; "rd" (distance between piles) equals 5 (five) feet (or equivalent distance in 'radians') and the inclusions (piles or columns, etc.) are 1 (one) foot in diameter, with a single piece of 1" (one inch) diameter rebar extending through and being cemented (etc.) into the footing (in this case). In this example, the footing dimension would be at or about 30 to 40 feet; and (in this embodiment) the most outer circle periphery "d" (constituting part of a fifth array subassembly 76) would have a diameter of about 45 (forty-five) feet.

Figure 14A:
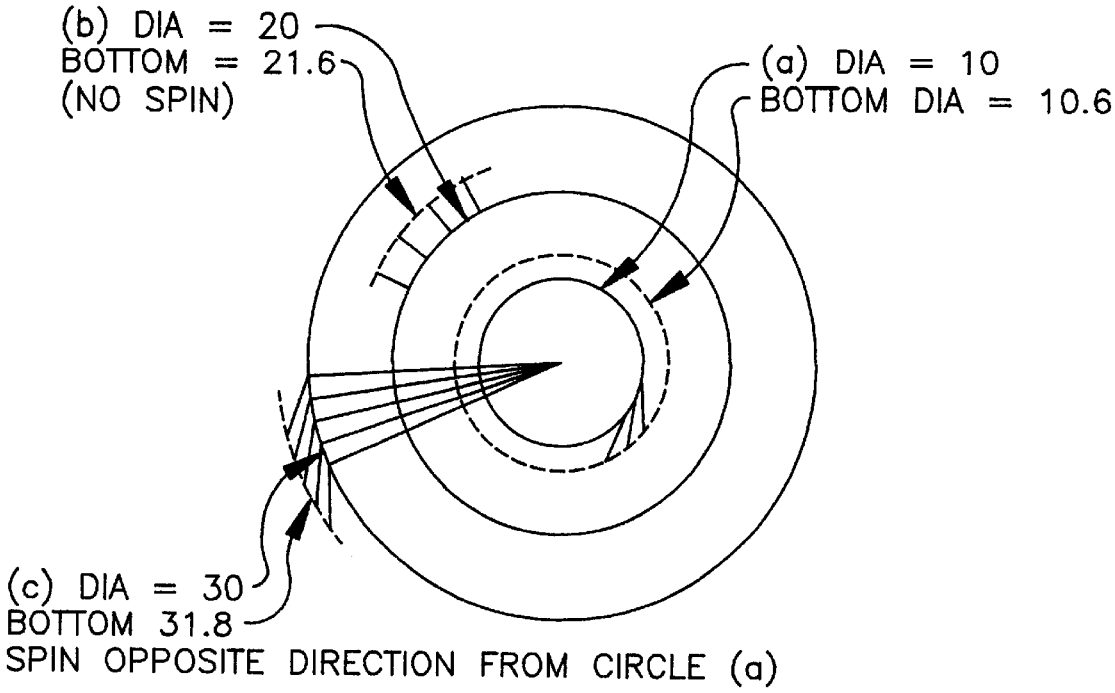
FIG. 14A is another schematic top view representation similar to that of FIG. 14, illustrating in part, by one example only, the effect of sloping and placing a pile unit at the theta angle of about 15 degrees, and the production or generation of a given second periphery within a given array subassembly (as is the case in the present invention of the relationship of the first to second periphery, the third to fourth periphery and the fifth to sixth periphery.
Figure 18:
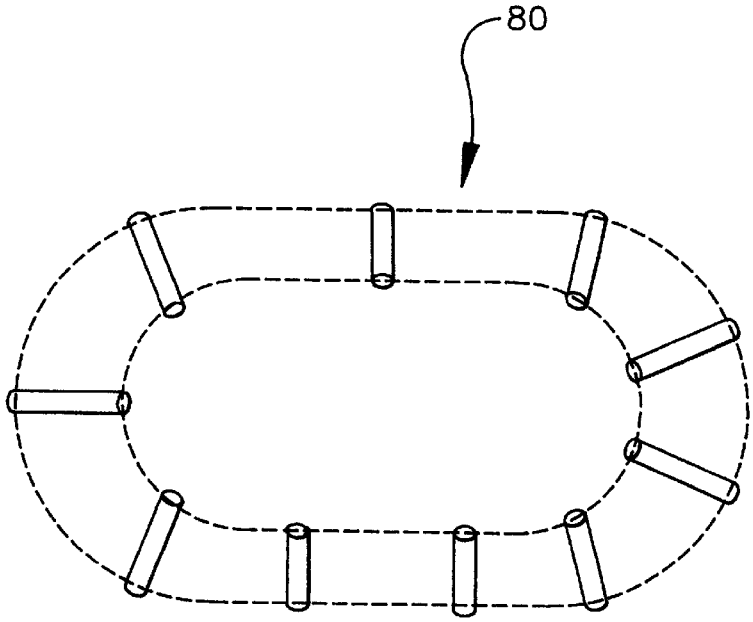
FIG. 18 is a partial schematic exemplar representation of an ellipsoid array positioning of pile members within one subassembly, from one periphery to another periphery; illustrating another preferred embodiment of the present invention.

Also, by example in FIG. 14A, the given initial diameters of the first periphery 22 (also shown in this FIG. as "(a)") of 10 feet; the third periphery 40 (also shown as "(b)") of 20 feet; and the fifth periphery 54 (shown as "(c)") of 30 feet; indicate a resulting respective diameter, after employing the theta angle of 15 degrees in sloping the included given pile members; of about 10.6 feet for the second periphery 24, 21.6 feet for the fourth periphery 42 and 31.8 feet for the sixth periphery 56, respectively.

In the related preferred embodiments discussed earlier herein, illustrated by example in the drawing figures referenced; an increasing dimensional magnitude is found and shown in the previous examples as one proceed through the following order, moving internally (or center-oriented) to externally (or farthermost-outside oriented): seventh periphery (70); first periphery (22); third periphery (40); second periphery (24); fifth periphery (54); fourth periphery (42); and sixth periphery (56).

Additionally, the scope and spirit of the present invention include a number of types of shapes of the plurality of peripheries and the array arrangement of pile members or units taught and employed by the present invention, based on circular, off-circle, elliptical, ellipsoidal, arc-like or arcuate, parabolic, paraboloid, hyperbolic, sinuous, sinusoidal, concentric or non-concentric (geometrically congruent or non-congruent) inter-relation of peripheries; and concave-concave, concave-convex and convex-convex juxtaposition or opposition. One such example of a preferred embodiment subassembly showing its two included peripheries in an ellipsoid array orientation 80 is shown, by example, in FIG. 18. It will be appreciated that paired periphery shapes (by virtue of the placement of given or employed pile units) do not have to be congruent with one another or be positioned the same distance apart along their adjoining perimeters.

Accordingly, the appended claims are intended to cover all changes, modifications and alterative options and embodiments falling within the true breath, scope and spirit of the present invention. The reader is, therefore, requested to determine the scope of the present invention by the appended claims and their legal equivalents, and not by the examples which have been given.

I claim:

1. A pile array assembly system for use in interaction with ground soil supporting and adjacent to footing attached or proximate to a ground surface structure, for reduced soil liquefaction and providing greater stability in the event of an earthquake or other seismic disturbance, said pile array assembly system comprising:

a first array subassembly having a plurality of pile units, each of said pile units having first and second ends and a lengthwise lateral wall extending therebetween, and being positioned and placed in interaction with a ground soil site at specific ground entry points so as to extend and slope at a theta-1 angle in relation to an imaginary vertical axis defined and extending from each of the respective entry points, such that the first ends of each of the respective pile units are generally positioned and placed so as to define, when imaginary interconnecting periphery lines are attached thereto, a first perimeter and the second ends of each of the respective pile units are generally positioned and placed so as to define, when imaginary interconnecting periphery lines are attached thereto, a second perimeter which is greater in dimensional magnitude than that of the first perimeter, a first positional axis being defined between the first and second ends extending between the first perimeter and the second perimeter as to each of the respective pile units of the first array subassembly;

a second array subassembly having a plurality of pile units, each of said pile units having first and second ends and a lengthwise lateral wall extending therebetween, and being positioned and placed in interaction with a ground soil site at specific ground entry points so as to extend and slope at a theta-2 angle in relation to an imaginary vertical axis defined and extending from each of the respective entry points, such that the first ends of each of the respective pile units are generally positioned and placed so as to define, when imaginary interconnecting periphery lines are attached thereto, a third perimeter and the second ends of each of the respective pile units are generally positioned and placed so as to define, when imaginary interconnecting periphery lines are attached thereto, a fourth perimeter which is greater in dimensional magnitude than that of the third perimeter, a first positional axis being defined between the first and second ends extending between the third perimeter and the fourth perimeter as to each of the respective pile units of the second array subassembly;

a third array subassembly having a plurality of pile units, each of said pile units having first and second ends and a lengthwise lateral wall extending therebetween, and being positioned and placed in interaction with a ground soil site at specific ground entry points so as to extend and slope at a theta-3 angle in relation to an imaginary vertical axis defined and extending from each of the respective entry points, such that the first ends of each of the respective pile units are generally positioned and placed so as to define, when imaginary interconnecting periphery lines are attached thereto, a fifth perimeter and the second ends of each of the respective pile units are generally positioned and placed so as to create, when imaginary interconnecting lines are attached thereto, a sixth perimeter which is greater in dimensional magnitude than that of the fifth perimeter, a first positional axis being defined between the first and second ends extending between the fifth perimeter and the sixth perimeter as to each of the respective pile units of the third array subassembly;

a fourth array subassembly having a plurality of pile units, each of said pile units having first and second ends and a lengthwise lateral wall extending therebetween, and being positioned and placed in interaction with a ground soil site at specific ground entry points generally proximal and along the fifth perimeter at points between the respective pile units of the third array so as to extend at a gamma angle in relation to an imaginary vertical axis extending from each of the respective entry points, such that the first ends of each of the respective pile units are generally positioned and placed generally proximal and along the fifth perimeter and the second ends of each of the respective pile units are generally positioned and placed so as to define, when imaginary interconnecting periphery lines are attached thereto, a seventh perimeter which is of less dimensional magnitude than that of the third perimeter.

2. The pile array assembly system of claim 1, wherein: the plurality of pile units in the first array subassembly is equal to from about five pile units to about seven pile units.

3. The pile array assembly system of claim 2, wherein: the plurality of pile units in the second array subassembly is equal to from about twelve pile units to about fourteen pile units.

4. The pile array assembly system of claim 3, wherein: the plurality of pile units in the third array subassembly is equal to at least about eighteen pile units.

5. The pile array assembly system of claim 4, wherein: the plurality of pile units in the fourth array subassembly is equal to from about 8 pile units to about twelve pile units.

6. The pile array assembly system of claim 5, wherein: the theta-1, theta-2 and theta-3 angles are each equal to from about 12 degrees to about 20 degrees.

7. The pile array assembly system of claim 6, wherein: the gamma angle is equal to from about 30 degrees to about 60 degrees.

8. The pile array assembly system of claim 7, wherein: the direction of the offset of the respective second ends of each of the pile units of the first pile array subassembly at the alpha-1 angle is generally opposite to the direction of the offset of the respective second ends of each of the pile units of the third pile array subassembly at the alpha-2 angle.

9. The pile array assembly system of claim 7, wherein: each of the respective pile units of the first, second and third array subassemblies extends a depth from a ground surface, into a preselected area of ground soil, of at least about 25 feet.

10. The pile array assembly system of claim 9, wherein: the respective pile units of the fourth array subassembly extend a depth which is equal to about half of the depth of the pile units of the third array subassembly.

11. The pile array assembly system of claim 10, wherein: the dimensional magnitude of the seventh perimeter of the fourth array subassembly is less than that of the first perimeter.

12. The pile array assembly system of claim 11, wherein: each of the respective pile units of the fourth array subassembly are positioned generally proximal to one another, generally intersecting within a common area, prior to each of the respective second ends thereof extending to a greater depth, in interaction with a ground site, to form the seventh perimeter of said fourth array subassembly.

13. The pile array assembly system of claim 10, wherein: each of the pile units of the first, second, third and fourth array subassemblies is selected from a group consisting of: mini-piles, resistant rigid piles, compaction piles, stone columns, caste concrete piles with internal rebar support therewithin, H-piles, I-piles, piles with steel or metal support inside; concrete, alloy, polymer, composite, metal and steel piles; and pile subsections fabricated and structured so as to define and have a number of lateral extensions having valley and peaks.

14. The pile array assembly system of claim 13, wherein: the entry points of pile units within the respective first, second and third array subassemblies are from about 1 foot to about 8 feet from one another.

15. The pile array assembly system of claim 14, wherein: each of the perimeters relate to one another in terms of an increasing dimensional magnitude in the following order: seventh perimeter, first perimeter, third perimeter, second perimeter, fifth perimeter, fourth perimeter, and sixth perimeter.

16. The pile array assembly system of claim 1, wherein: each of the plurality of pile units of the first array subassembly is further positioned along an axis generally transverse to that of the vertical axis such that each of the respective second ends is offset by an alpha-1 angle in positional relation to the first positional axis thereof.

17. The pile array assembly system of claim 16, wherein: the alpha-1 angle is equal to from about 2 degrees to about 20 degrees.

18. The pile array assembly system of claim 16, wherein: each of the plurality of pile units of the third array subassembly is further positioned along an axis generally transverse to that of the vertical axis such that each of the respective second ends is offset by an alpha-2 angle in positional relation to the first positional axis thereof.

19. The pile array assembly system of claim 18, wherein: the alpha-2 angle is equal to from about 2 degrees to about 20 degrees.

20. An angular pile array assembly system for use in providing reduced liquefaction in ground soil adjacent to footing and building or ground surface structures, when installed in interaction therewith, said angular pile array assembly system comprising:

a first array subassembly having from about 5 pile members to about 7 pile members, each of said pile members having first and second ends and a lengthwise lateral wall extending therebetween, the first ends of each of the respective pile members being generally positioned and placed so as to define, when imaginary interconnecting arc lines are attached thereto, a first periphery, circumferential in configuration, and the second ends of each of the respective pile members being generally, positionally sloped and placed so as to define when imaginary interconnecting arc lines are attached thereto, a second periphery, circumferential in configuration, which is greater in dimensional magnitude than that of the first periphery and commonly defines and shares a centre point with said first periphery, a first positional axis being generally defined along each pile member extending between the first and second circumferential peripheries of the first array subassembly;

a second array subassembly having from about 12 pile members to about 14 pile members, each of said pile members having first and second ends and a lengthwise lateral wall extending therebetween, the first ends of each of the respective pile members being generally positioned and placed so as to define, when imaginary interconnecting perimeter lines are attached thereto, a third periphery, and the second ends of each of the respective pile members being generally, positionally sloped and placed so as to define when imaginary interconnecting perimeter lines are attached thereto, a fourth periphery which is greater in dimensional magnitude than that of the third periphery and commonly defines and shares a centre point with said first periphery, a first positional axis being generally defined along each pile member extending between the third and fourth peripheries of the second array subassembly;

a third array subassembly having at least about 18 pile members, each of said pile members having first and second ends and a lengthwise lateral wall extending therebetween, the first ends of each of the respective pile members being generally positioned and placed so as to define, when imaginary interconnecting arc lines are attached thereto, a fifth periphery, circumferential in configuration, and the second ends of each of the respective pile members being generally, positionally sloped and placed so as to define when imaginary interconnecting arc lines are attached thereto, a sixth periphery, circumferential in configuration, which is greater in dimensional magnitude than that of the fifth periphery and commonly defines and shares a centre point with said fifth periphery, a first positional axis being generally defined along each pile member extending between the fifth and sixth peripheries of the third array subassembly; and a fourth array subassembly having from about 8 pile members to about 12 pile members, each of the pile members having first and second ends and a lengthwise lateral wall extending therebetween, the first ends of each of the respective pile members being generally positioned along the fifth periphery of the third array subassembly at positional locations between the respective first ends of the respective pile members of said third array subassembly, and the respective second ends of each of the respective pile members of said fourth array subassembly being positioned and placed so as to define, when imaginary interconnecting perimeter lines are attached thereto, a seventh periphery which is of less dimensional magnitude than that of the fifth periphery of the third array subassembly, a first positional axis being generally defined along each pile member of said fourth array subassembly, extending between the fifth periphery of the third array subassembly and the seventh periphery of the fourth array subassembly.

21. The angular pile array assembly system of claim 20, wherein:

the first positional axis of each of the respective pile members of the first array subassembly extends at an angle theta-1 equal to from about 12 degrees to about 20 degrees in relation to the centre point of the first and second peripheries;

the first positional axis of each of the respective pile members of the second array subassembly extends at an angle theta-2 equal to from about 12 degrees to about 20 degrees in relation to the centre point of the third and fourth peripheries;

the first positional axis of each of the respective pile members of the third array subassembly extends at an angle theta-3 equal to from about 12 degrees to about 20 degrees in relation to the centre point of the fifth and sixth peripheries; and the first positional axis of each of the respective pile members of the fourth array subassembly extends at an angle gamma equal to from about 30 degrees to about 60 degrees in relation to the centre point of the fifth periphery.

22. The angular pile array assembly system of claim 21, wherein:

each of the first and second peripheries of the first array subassembly and the fifth and sixth peripheries of the third array subassembly is circular in configuration.

23. The angular pile array assembly system of claim 22, wherein:

each of the second ends of the respective pile members of the first array subassembly is rotatively advanced in a first direction and positioned at an arcuate distance along the second periphery equal to an angle alpha-1 in relation to the centre point of the first and second peripheries, while retaining each of the first ends of the respective pile members as originally positioned and placed along the first periphery.

24. The angular pile array assembly system of claim 23, wherein:

each of the second ends of the respective pile members of the third array subassembly is rotatively advanced in a direction generally opposite to the first direction of the second ends of the respective pile members of the first array subassembly, and positioned at an arcuate distance along the sixth periphery equal to an angle alpha-2 in relation to the centre point of the fifth and sixth peripheries, while retaining each of the first ends of the respective pile members as originally positioned and placed along the fifth periphery.

25. The angular pile array assembly system of claim 24, wherein:

each of the respective pile members of the first, second and third array subassemblies extends a depth, when installed in interaction with a ground site, of at least about 25 feet, and wherein:

the alpha-1 and alpha-2 angles are each equal to from about 6 degrees to about 10 degrees.

26. The angular pile array assembly system of claim 25, wherein:

the respective pile members of the fourth array subassembly extend a depth, when installed in interaction with a ground site, which is equal to about half of the depth of the pile members of the third array subassembly.

27. The angular pile array assembly system of claim 26, wherein:

the dimensional magnitude of the seventh periphery of the fourth array subassembly is less than that of the first periphery of the first array subassembly.

28. The angular pile array assembly system of claim 27, wherein:

each of the respective pile members of the fourth array subassembly are positioned generally proximal to one another, generally intersecting within a common area, prior to each of the respective second ends thereof extending to a greater depth, in interaction with a ground site, to form the seventh periphery of said fourth array subassembly.

29. The angular pile array assembly system of claim 28, wherein:

each of the pile members of the first, second, third and fourth array subassemblies is selected from a group consisting of: mini-piles, resistant rigid piles, compaction piles, stone columns, caste concrete piles with internal rebar support therewithin, H-piles, I-piles, piles with steel or metal support inside; concrete, alloy, polymer, composite, metal and steel piles; and pile subsections fabricated and structured so as to define and have a number of lateral extensions having valley and peaks.

30. The angular pile array assembly system of claim 29, wherein:

the original positioning and placement of the respective pile members along the respective first, second and third array subassemblies is in accordance with a distancing of from about 1 foot to about 8 feet from one another.

31. The angular pile array assembly system of claim 30, wherein:

each of the peripheries relate to one another in terms of an increasing dimensional magnitude in the following order: seventh periphery, first periphery, third periphery, second periphery, fifth periphery, fourth periphery, and sixth periphery.

* * * * *